US008477979B2

(12) United States Patent
O'Neill

(10) Patent No.: US 8,477,979 B2
(45) Date of Patent: Jul. 2, 2013

(54) COMPRESSION DRIVER AND HORN STRUCTURE

(76) Inventor: Robert M. O'Neill, Oxford, MS (US)

( * ) Notice: Subject to any disclaimer, the term of this patent is extended or adjusted under 35 U.S.C. 154(b) by 674 days.

(21) Appl. No.: 12/530,383

(22) PCT Filed: Mar. 10, 2008

(86) PCT No.: PCT/US2008/003123

§ 371 (c)(1),
(2), (4) Date: Feb. 27, 2010

(87) PCT Pub. No.: WO2008/112175

PCT Pub. Date: Sep. 18, 2008

(65) Prior Publication Data

US 2011/0311087 A1 Dec. 22, 2011

Related U.S. Application Data

(60) Provisional application No. 60/905,912, filed on Mar. 9, 2007.

(51) Int. Cl.
*H04R 25/00* (2006.01)

(52) U.S. Cl.
USPC ..... 381/343; 381/339; 381/340

(58) Field of Classification Search
USPC .. 381/338, 339, 340, 341, 342, 343; 181/152, 181/159, 177, 185, 187, 195
See application file for complete search history.

(56) References Cited

U.S. PATENT DOCUMENTS

| | | | | |
|---|---|---|---|---|
| 2,183,528 | A * | 12/1939 | Blackburn | 181/159 |
| 5,117,462 | A * | 5/1992 | Bie | 381/343 |
| 6,064,745 | A * | 5/2000 | Avera | 381/340 |
| 6,343,133 | B1 * | 1/2002 | Adamson | 381/340 |

* cited by examiner

*Primary Examiner* — Huyen D Le
(74) *Attorney, Agent, or Firm* — J.A. McKinney & Assoc., LLC

(57) ABSTRACT

A loudspeaker driver 100 with new horn throat configuration 120 has a phase plug summation plane radius that is also the effective throat of the driver. The selected plane "D" where the elements of the horn that provide directional information to the wave front are implemented is made part of the geometry of the magnetic return circuit back plate 108. The portion of the back plate that is coincident with the selected plane "D" has a lumen or opening that is made equal to the radius of the circle defined by the phase plug summation plane. The geometry of the back plate's lumen controls projected sound's radiation pattern.

8 Claims, 24 Drawing Sheets

CONVENTIONAL DRIVER

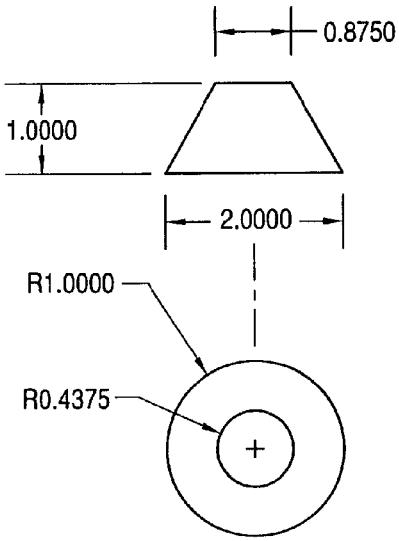
Figure 2a
2" diameter
conventional
throat
FIG. 2a
PRIOR ART
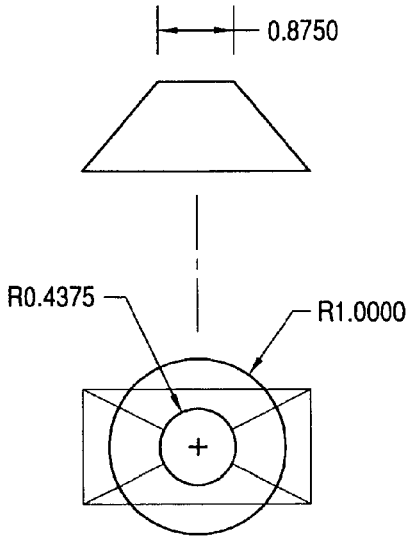
Figure 2b
0.875" diameter
equivalent
throat
FIG. 2b
PRIOR ART Conventional Driver/Horn Horn of Fig. 8

ET Permanent magnet to be neodymium iron boron SH37
coating to be EDP or nickel

COMPRESSION DRIVER AND HORN STRUCTURE

PRIORITY CLAIMS AND REFERENCE TO RELATED APPLICATIONS

This is a Continuation application which claims priority under 35 U.S.C. 120 and 35 U.S.C. 111(a) as the U.S. National Phase under 35 USC 371 of PCT/US2008/003123, filed Mar. 10, 2008; published, in English, as WO 2008/112175 on Sep. 18, 2008 and also claims priority to U.S. provisional patent application 60/905,912 tiled Mar. 9, 2007, the entire disclosures of which are expressly incorporated herein by reference.

BACKGROUND OF THE INVENTION

1. Technical Field of the Invention

The present invention relates to electromechanical transducer structures and, more particularly, to loudspeaker compression driver and horn structures.

2. Description of the Background Art

Conventional prior art audio frequency reproduction systems use transducers to convert electrical energy to acoustical energy. Systems used for the reinforcement of speech and music are referred to as Sound Reinforcement Systems. These systems are used to reinforce the program material (voice, music or other material) by providing an increase in signal level or gain in order to generate sufficient sound pressure levels in large spaces.

Sound reinforcement systems often use devices known as compression drivers and horns to reinforce the program material. The compression driver is a simple acoustic transducer that uses a small and light weight diaphragm to convert the electrical signals to acoustic signals. The small diaphragm will exhibit fewer resonant modes than a large diaphragm and the lower mass associated with a small diaphragm can produce a higher conversion efficiency.

The small diaphragm, however, has a lower radiation impedance than a larger diaphragm so a horn is coupled to the "exit" of the compression driver. The horn performs an impedance matching function and acts to "transform" the low radiation impedance of the driver to a higher radiation impedance associated with the mouth of the horn radiating into free space. The small entrance of the horn is mated to the small diameter acoustic exit of the compression driver. The acoustic impedance associated with this small area is then transformed to a higher acoustic impedance associated with the larger opening of the horn, referred to as the horn mouth. The rate at which the cross sectional area of the horn changes between the small opening (or throat) and the large opening (or mouth) is referred to as the flare rate.

In addition to acting like an acoustic transformer, the horn also acts to direct the radiated energy in a specific location. The walls of the horn act to guide the radiated wave fronts. In this way the total radiated acoustic power from the driver is concentrated into a portion of space smaller than the space had the horn not been mounted to the driver. The acoustic density, or energy per unit area, is increased and, as a result, the sound pressure level in an area is higher than it would be if the horn were not coupled to the driver for long wavelength conditions (i.e., when the radiated wavelength is long relative to the horn it is referred to as a "long wavelength"). It is a common practice for horns to exhibit circular, elliptical, square, or rectangular radiation patterns.

This horn/driver system has a bandwidth or operating range. The low frequency response of the horn/driver system is limited by the length and mouth area of the horn. When the radiated wavelengths become large compared to the length and mouth circumference, the horn is no longer able to radiate any appreciable acoustic power and the overall horn/driver efficiency is substantially reduced. For the mouth of the horn to have relatively high acoustic impedance, the following relationship must be maintained:

$$ka>1 \quad (1)$$

where k=(2*pi)/wavelength and a=mouth radius.

This equation basically requires that mouth circumference (i.e., 2*pi*a) be greater than the wavelength of the lowest frequency to be effectively radiated. This frequency, where the wavelengths become long relative to the mouth circumference, is referred to as the cutoff frequency.

There are many parameters that affect the high frequency response of the compression driver and horn combination. A specific area of interest is the high frequency limit related to the system's ability to maintain the desired directional pattern. A desirable property of a horn is its ability to maintain a specific directional pattern independent of frequency. These horns, are often referred to as "constant directivity" horns (see "What's SO Sacred About Exponential Horns", Keele, D. B. Audio Engineering Society 51$^{st}$ Convention, May 13-16, 1975). Many sound reinforcement applications require this property for accurate coverage of a specific area.

The ability of a horn to maintain constant directivity is related to the radius of the compression driver exit. As the wavelengths become short compared to the exit radius, the directivity pattern of the wave front emerging from the driver exit is reduced, becoming more narrow. The directivity pattern of the radiated waveform has a main lobe with a width referred to as the beamwidth. The beamwidth is described in terms of an angular extent from a central axis of the horn, where the axial (or "on-axis") response is measured from the horn's central or major axis. The specific angle is determined by finding the points on either side of the horn's major axis where the sound pressure level ("SPL") has decreased 6 dB from the SPL measured on axis. (This assumes that the acoustic pressure is a maximum on the horn's central or major axis). The included angle between the −6 dB points is referred to as the beamwidth. If the radiated directivity, or beamwidth, becomes less than the included angles of the horn, then the radiation pattern is no longer constant and the wave front radiated by the driver is no longer controlled by the included angles of the horn. (Reference "On the Radiation of Sound from an Unflanged Circular Pipe", Levine and Schwinger Physical Review, Vol 73 Number 4, 1948), ("Acoustics", Beranek, Chapter 4 Radiation on Sound, McGraw-Hill 1954).

FIG. 1 is a cross sectional view of a typical compression driver. A diaphragm mounted to a flexible membrane has an annular coil attached. The annular coil, or voice coil, is suspended in the magnetic gap and the diaphragm is spaced over the phase plug. Acoustic radiation from the diaphragm is transmitted thru the openings in the phasing plug. The phase plug openings may be radially oriented, circumferentially oriented, or a series of simple holes. The summation of the cross sectional areas associated with the phase plug openings forms the acoustic loading of the diaphragm. This phase plug cross sectional area can be made equal to the diaphragm area but is usually substantially lower. The change in cross sectional area between the diaphragm and the phase plug openings is the source of the loading. The volume of air between the diaphragm and the phase plug is compressed due to this reduction in area. The radiation impedance is increased by the square of the ratio of the diaphragm area and the phase plug's initial area.

The individual channels of the phase plug add to an overall area, still smaller than that of the diaphragm area, at the plane defined in FIG. 1 as "plane "A"". Typical compression driver design then includes some linear distance proceeding toward the outlet, or throat of the driver, that expands the cross sectional area in some fashion. This section may be the length defined by the thickness of the magnetic return path backplate. This length is shown in FIG. 1 as the distance between plane "A" and plane "B". In other common designs an adaptor plate is added to the rear of the magnetic return backplate and is the thickness defined by the distance between plane "B" and plane "C". The area at plane "B" or plane "C" is always larger than the area of plane "A" in order to not introduce acoustic reflections associated with a reduction in area.

As a consequence of moving farther away from plane "A", and the necessary increases in cross sectional area, the associated radius at any plane away from the summation point of the phase plug (plane "A") is increased. This increase in the radius then limits the ability of the driver to produce a wide dispersion and broad radiation pattern as frequency is increased.

There is a need, therefore, for a compression driver motor structure that overcomes these problems and provides a wider dispersion and broader radiation pattern as frequency is increased, for a given horn mouth configuration.

SUMMARY OF THE INVENTION

There has been summarized above, rather broadly, the prior art that is related to the present invention in order that the context of the present invention may be better understood and appreciated. In this regard, it is instructive to also consider the objects and advantages of the present invention.

It is an object of the present invention to overcome the above mentioned difficulties by providing a compression driver motor structure that overcomes these problems and provides a wider dispersion and broader radiation pattern as frequency is increased.

It is also an object of this invention to provide a compression driver motor structure that reliably generates sound in a wide dispersion in the horizontal plane over a larger bandwidth for a horn mouth of a selected rectangular configuration.

The aforesaid object(s) are achieved individually and in combination, and it is not intended that the present invention be construed as requiring two or more of the objects to be combined.

Returning to the discussion on the horn's throat, applicant's inspection of FIG. 1 led to an investigation into whether the most ideal location for a throat with a minimized radius is at the location shown in the drawing as plane "A"'. This is the point where the cross sectional area is the smallest and, as a result, the radius is minimal for any given design.

There is no specific radius or associated area that will best optimize the performance. The applicant has discovered that an optimal area is a function of the plane immediately at the summation point of the phase plug. The area at the summation point of the phase plug will be related to design features such as compression ratio and driver diaphragm area. What is important in order to maximize the high frequency radiation pattern bandwidth is that, for any given summation plane area, the "driver throat" begin at this plane.

In accordance with the present invention, a new horn throat configuration has a phase plug summation plane radius that is also the effective throat of the driver. At this plane the elements of the horn that provide directional information to the wave front are implemented.

Coupling the required radiation geometry to the driver (i.e. the horn) at the phase plug summation plane results in an improved or higher high frequency limit (e.g., 13,500 Hz). From this example, it can be seen that there is substantial advantage in having a horn that imparts directional information to the wave fronts coupled to a driver using the smallest possible radius.

This is accomplished by altering the geometry of the magnetic return circuit back plate, as compared to the prior art. The portion of the back plate that is coincident with reference plane "A" (as discussed regarding FIG. 1) has an opening that is made equal to the radius of the circle defined by the phase plug summation plane. The geometry of the plate then immediately begins to form the desired horizontal and vertical (or radial in the case of a circular or elliptical radiation pattern). As an example, the horizontal included angle beginning at the phase plug summation plane could be 100 degrees and the vertical could also be 100 degrees, or any other included angle that would be less than the limit imposed by the phase plug summation plane radius. (A typical practice would be to have a 100 degree horizontal pattern and a 60 degree to 40 degree included angle in the vertical plane).

In an exemplary embodiment, the throat radius, "a", is reduced, the high frequency limit is increased, and so the horn/driver combination is capable of directional control at higher frequencies. Applicant's data describes the directional behavior of an un-flanged tube. When an acoustic "flange" is added the directional behavior will be altered (this change in the radiation pattern is shown in "*Acoustics*" by Beranek, FIG. 4.20). The dispersion in actually increased (i.e., the beamwidth increases) between Ka=1.5 and Ka=4. The data shown compares a piston in an infinite plane baffle, a piston at the end of a long tube (the data from tables 2 and 3) and a piston in free space (no baffle). The addition of a horn to the exit aperture of a driver will alter the directional response and, for certain values of Ka will increase the dispersion angle, or beamwidth. The horn will alter the dispersion characteristics much like the addition of a baffle in FIG. 4.20 of Beranek. This effect is shown in the actual measured data.

Prior art designs have resolved this inherent inability of a driver/horn combination to control dispersion at frequencies above the point where the exit radius became larger than the radiated wavelengths by utilizing a diffraction slot. This diffraction slot is placed at some distance beyond the plane referred to as plane "B" or plane "C".

Diffraction is an effect that produces spreading of a wave form when that wave form encounters a gap, or slit. The smaller the slit relative to the wavelength, the wider the resultant spreading of the waveform relative to its original. This spreading will increase the dispersion pattern, or beamwidth of the radiated wave. Diffraction slots are an effective way to broaden a wavefront that has become narrow due to the exit radius of the driver being large relative to the radiated wavelengths.

The use of diffraction slots can present two basic problems. The first problem is that diffraction slots represent a change in cross sectional area. This area change, or discontinuity, will produce a reflected wave in the horn. The reflected wave produces both time domain distortion as well as a change in the amplitude versus frequency response of the horn/driver system.

The second difficulty with diffraction slots, if they are located between the driver exit and the horn mouth, is that they can introduce path length differences associated with the physical geometry required to transition from the driver exit geometry to the narrow slot required to produce the necessary diffraction to achieve a requires dispersion, or beamwidth.

These path length differences can result in uneven acoustical summing of the waveforms due to the phase differences associated with the different path lengths.

It should be noted that when a horn is designed to produce a specific radiation or dispersion pattern, discontinuities are typical. The designer's goal is to minimize the number and magnitude of those discontinuities.

The Equivalent Throat driver of the present invention has an exit radius that is identical to and coincident with the phase plug summation plane. Based on applicant's data (see below, in Tables 1 and 2), a smaller exit radius will produce a wider dispersion pattern (i.e., a larger included angle and larger beamwidth).

For the horn throat of the present invention, the throat's walls define an included angle "x" beginning at plane "D". Because included angle x begins at plane "D", the driver/horn combination provides directional control to the wavefront at the optimal point, where the radius is smallest and the high frequency limit bandwidth is greatest. It is typical for a horn with a rectangular radiation pattern (i.e. 90 degrees horizontal by 40 degrees vertical, 120 degrees horizontal by 60 degrees vertical, 60 degrees horizontal by 40 degrees vertical, or any of a set of possibilities of horizontal by vertical rectangular geometries) to have two different angles beginning at plane "D". It is also possible to have identical angles if the desired radiation pattern is square or a single angle if the desired pattern is oval in nature. (i.e. circular or elliptical or any other "round" geometry).

A prototype embodiment of the Equivalent Throat (ET) driver of the present invention was designed to develop a rectangular radiation pattern. The geometry within the section of the magnetic return path's steel back plate is shaped to form a portion of the actual throat geometry. The equivalent throat design uses the entire thickness of the magnetic return path steel back plate to form the initial portion of the desired horizontal and vertical (for a rectangular implementation) radiation pattern of the driver/horn combination. The salient feature of the design is that the desired radiation geometry begins at the phase plug summation plane where the exit radius can be made a minimum for any given driver design. This requires that the thickness of the back plate, from plane "A", be configured to have the shape required to form the desired radiation geometry of the wavefront. This differs from a conventional design in that the conventional design has an exit radius on plane "B" (e.g., of FIG. 1). The conventional design's exit radius is displaced from the phase plug summation plane by the thickness of the magnetic return path steel back plate. The conventional design exit radius is larger than the radius at the phase plug summation plane.

An equivalent throat driver with a matching equivalent throat horn differs from a conventional driver with conventional horn in that the entrance geometry of the horn must match the exit geometry of the driver or be adapted to the radius of the phase plug summation plane. In the exemplary embodiment the horn's widest included angle (in the case of a rectangular pattern implementation) matches that of the widest angle that the radius associated with the phase plug summation plane.

In accordance with the present invention, the entrance geometry of the horn matches the geometry of the driver's exit as defined (in the exemplary embodiment) by the interior surfaces of the backplate's central opening when mated to the horn's throat to provide a virtually seamless horn interior sidewall from phase plug to well within the horn's throat. This means that a cross sectional view of the driver and horn assembly taken at any angle would show a co-linear interior sidewall surface that flares at a constant angle from within the driver's exit, across the plane of the driver/horn coupling and into the horn's throat. The ET driver's exit aperture in the backplate has sidewalls that taper away from one another, and so are not parallel, as in conventional drivers.

Other horn geometries, all with a rated beamwidth less than that supported by the phase plug summation plane radius may certainly be used with an equivalent throat driver. As is the case with every "equivalent throat" horn made in accordance with the present invention, the geometry of the horn has sidewall interior surfaces that begin diverging at a desired included angle at the plane of the horn entrance.

Acoustical measurements of the horn and driver combination of the present invention indicate good agreement with the theory of the present invention. The radius of the phase plug summation plane for an equivalent throat driver prototype is 0.55 inches. The radius at the exit of the conventional driver is 0.675 inches. The predicted difference in the high frequency dispersion limit is 1757 Hz. The measured difference is approximately 1800 Hz, representing excellent agreement.

The absolute magnitude of the beamwidth's included angle (−6 dB points) and associated frequency, however, are different. The corresponding frequency for −6 dB included angles and a radius of 0.55 inches (the equivalent throat horn/driver combination) is approximately 9820 Hz. The measured frequency is approximately 11,400 Hz. (The conventional horn/driver, with an exit radius of 0.675 inches produces a measured included angle of approximately 9600 Hz). In both cases, the difference between the data calculated and the measured results are thought to be associated with acoustic end correction and boundary conditions. The equivalent throat driver/horn combination of the present invention also provides less variation between on axis and off axis response, indicating the ability to maintain a wider main lobe beam width at a higher frequency.

It should also be stated that the −6 dB included angle for the equivalent throat driver/horn combination is 100 degrees and occurs at 11.5 kHz. The conventional driver/horn combination −6 dB included angle is 90 degrees and occurs at 9.6 kHz. It has been discovered that the equivalent throat driver must incorporate the widest included angle to achieve the necessary dispersion, and other horn geometries may then be designed with narrower dispersion angles. Other narrower dispersion pattern horns will function in a traditional manner with the ET driver of the present invention, as long as the horn entrance radius matches the phase plug summation plane radius on the ET driver.

Conventional or prior art compression drivers have an exit radius that is larger than the phase plug summation radius and is separated some distance from the plane where the phase plug summation radius is located. Because the exit radius on conventional devices is larger than the summation plane radius, the high frequency dispersion performance of the driver is limited by the exit radius.

Equivalent throat driver/horn combinations utilize the compression driver summation plane radius as the exit throat. By utilizing the summation plane radius the high frequency dispersion limit is increased.

Equivalent throat driver/horn designs also use utilize the compression driver magnetic return back plate's thickness to define a novel throat-like segment with an included angle (or combination of angles) to impart directional influence on the emerging wavefront.

The widest dispersion horn has a rear geometry that matches the exit geometry of the equivalent throat driver. Other horns may easily be used with the equivalent throat driver providing the horn has its widest dispersion, or beamwidth, that is equal to or less than the included angle, or angles, on the equivalent throat driver.

The novel and unique aspect of the Equivalent Throat system is that the driver is capable of producing wider dispersion and beamwidth than a conventional driver because the exit radius is coincident with the phase plug summation plane. As has been shown, a smaller radius exit will produce a wider dispersion.

It will be appreciated by those having skill in the art that the Equivalent Throat system of the present invention is also capable of generating dispersions, or beamwidths, narrower than the included angle of the Equivalent Throat driver when other Equivalent Throat horns, of reduced dispersion angle are coupled to the driver. These reduced dispersion (higher Q) horns are coupled to the exit geometry of the Equivalent Throat driver by having an "inverse" geometry that will mate with the Equivalent Throat driver and allow the entrance radius of the horn to mate with the phase plug summation plane radius.

The structure and method of present invention also make available a transducer adapted for use as a loudspeaker, comprising a compression driver having a phase plug and compression driver exit with a selected compression driver exit area (e.g., defined in a back plate) at a selected plane; a flared, impedance matching, horn having a proximal horn throat adapted to engage and receive an acoustic signal from said compression driver exit; wherein a radiation pattern is generated in response to excitation of the compression driver, and the radiation pattern includes horizontal and vertical radiation from the compression driver beginning at the exit plane of the phase plug where the radius of the substantially circular plane is much smaller than the exit radius or effective exit radius on the driver's backplate, such that the driver provides an "equivalent throat" design if at least one axis (horizontal or vertical for a rectangular radiation pattern) has an included angle equal to the beamwidth produced by the phase plug's summation plane radius.

The above and still further objects, features and advantages of the present invention will become apparent upon consideration of the following detailed description of a specific embodiment thereof, particularly when taken in conjunction with the accompanying drawings, wherein like reference numerals in the various figures are utilized to designate like components.

BRIEF DESCRIPTION OF THE DRAWINGS

FIG. 2*a* is a diagram illustrating characteristics of a conventional horn's throat.

FIG. 2*b* is a diagram illustrating characteristics of an Equivalent Throat structure, in accordance with the present invention.

DESCRIPTION OF THE PREFERRED EMBODIMENTS AND BEST MODES FOR CARRYING OUT THE INVENTION

Before explaining exemplary embodiments and methods of the present invention in detail (as illustrated in FIGS. 2B-24C), it is to be understood that the invention is not limited in its application to the details of construction and to the arrangements of the components set forth in the following description or illustrated in the Figures. The invention is capable of other embodiments and of being practiced and carried out in various ways. Also, it is to be understood that the phraseology and terminology employed herein are for the purpose of description and should not be regarded as limiting.

Figure 1:
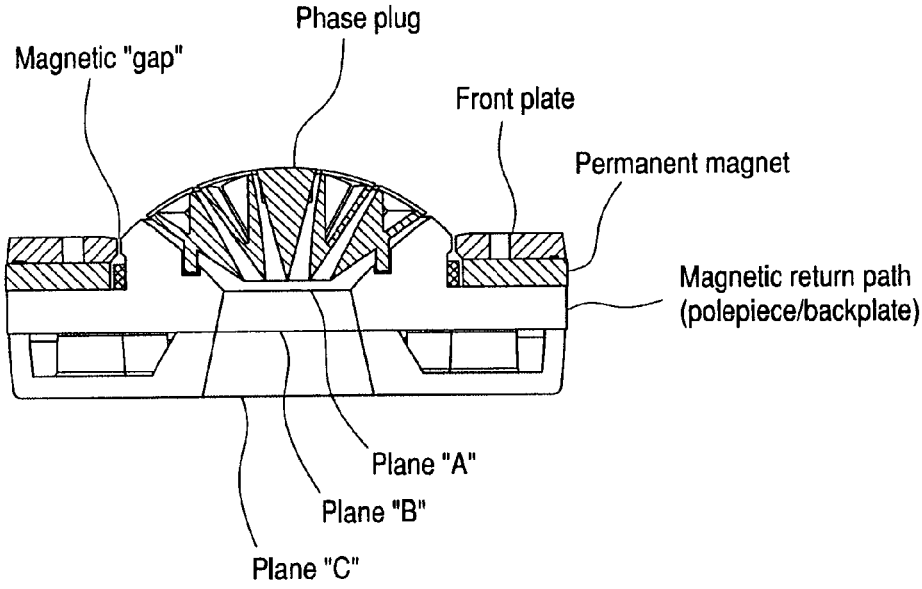
FIG. 1 PRIOR ART
FIG. 1 illustrates a conventional compression driver system.

Returning to the background discussion on a horn's throat, applicant's study of FIG. 1 prompted applicant to explore whether the most ideal location for a throat with a minimized radius is at the location shown in the drawing as plane "A", where the cross sectional area is the smallest and, as a result, the radius is minimal for any given design.

There is no specific radius or associated area that will best optimize the performance. The optimal area will be a function of the plane immediately at the summation point of the phase plug. The area at the summation point of the phase plug will be related to design features such as compression ratio and driver diaphragm area. What is important in order to maximize the high frequency radiation pattern bandwidth is that, for any given summation plane area, the "driver throat" begin at this plane.

FIG. 2*a* illustrates a conventional compression driver with a radius of 0.4375 inches 0.875" diameter) at the summation plane of the phase plug. This figure shows a length that connects this summation plane to the "nominal" exit of the driver. This 1 inch radius (2" diameter) is a very common exit dimension for professional compression drivers. This 1 inch radius produces a high frequency limit of 5400 Hz for a 100 degree radiation pattern.

Figure 3:
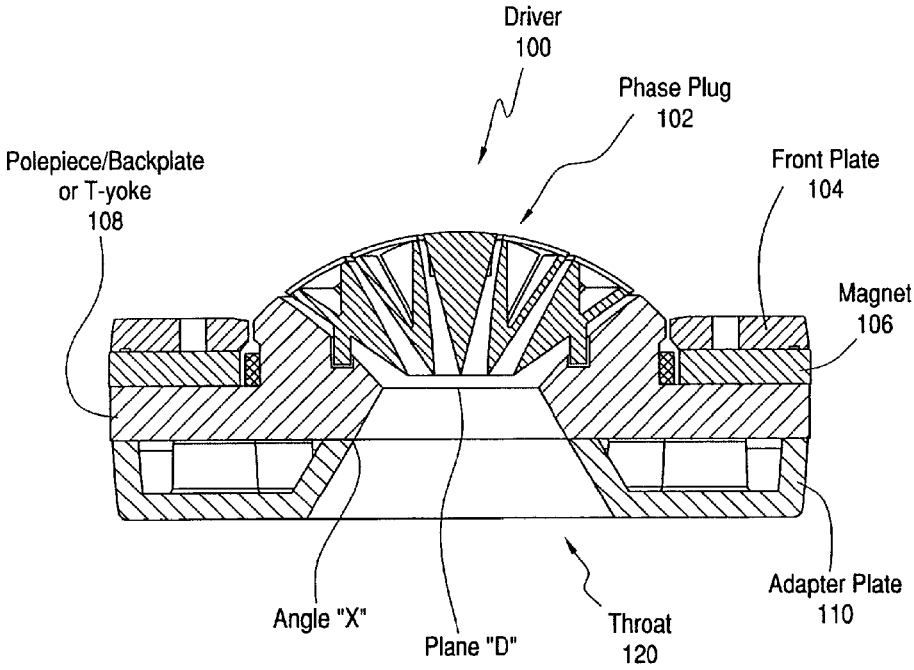
FIG. 3 is a cross section, in elevation illustrating characteristics of an Equivalent Throat driver structure, in accordance with the present invention.

In accordance with the present invention, the configuration represented in FIG. 2*b* has the same phase plug summation plane radius but in driver 100 as shown in FIG. 3 this is also the effective throat 120 of the driver. At this plane, novel structural elements of the horn that provide directional information to the wave front are implemented. The horn structure of the present invention differs from the situation in FIG. 2*a* where the conventional horn would be coupled to the driver at the 1 inch radius, rather than the 0.4375 radius.

As shown in FIG. 3, Driver 100 includes an annular magnet 106 stacked with annular front plate 104 which defines a magnetic gap at its peripheral edge. The inner peripheral edge of the magnetic gap is defined by Polepiece/backplate or T-Yoke 108 which is substantially symmetrical about a central axis that is co-axially aligned with the ET horn's throat 120. Polepiece/backplate or T-Yoke 108 is a ring-shaped member having an upper or diaphragm side and a lower or horn side, and the horn side has an axially aligned aperture therethrough with tapered inside walls and a central region of smallest diameter corresponding to "plane D", where the sidewalls on the horn side are angled away from one another by a selected angle "X" chosen to provide the desired ET horn throat characteristics. Phase plug 102 is received in and supported by T-Yoke 108 and provides an impedance matching set of channels between a diaphragm's pressurized volume and "plane D."

Coupling the required radiation geometry to the driver (i.e. the horn) at the phase plug summation plane "D" results in a high frequency limit of 13,500 Hz. From this example, it can be seen that there is substantial advantage in having a horn that imparts directional information to the wave fronts coupled to a driver (e.g., 100) using the smallest possible radius.

This is accomplished by altering the geometry of the magnetic return circuit back plate 108, as compared to the prior art. The portion of back plate 108 that is coincident with reference plane "A" (as discussed regarding FIG. 1) has an opening that is made equal to the radius of the circle defined by the phase plug summation plane. The geometry of the plate 108 then defines the desired horizontal and vertical (or radial in the case of a circular or elliptical radiation pattern) constraints. As an example, the horizontal included angle (e.g., angle "X") beginning at the phase plug summation plane "D" could be 100 degrees and the vertical could also be 100 degrees, or any other included angle that would be less than the limit imposed by the phase plug summation plane radius. (A typical practice would be to have a 100 degree horizontal pattern and a 60 degree to 40 degree included angle in the vertical plane).

As a reference, data taken from the text "Acoustics" by Beranek can be configured as shown in Table 1, below:

TABLE 1

| Ka | Included angle directional response (−6 dB) |
|---|---|
| 0.5 | Nearly Omni directional |
| 1.0 | Nearly Omni directional (but reducing included angle) |
| 1.5 | Approximately 150 degrees |
| 2.0 | Approximately 120 degrees |
| 2.5 | Approximately 100 degrees |
| 3.0 | Approximately 75 degrees |
| 3.8 | Approximately 65 degrees |

$$\text{Where } k=(2*pi)/\text{wavelength and } a=\text{exit radius} \quad (2)$$

To continue the example, if an included angle of 100 degrees is required the data above suggests that the value of Ka should be approximately 2.5. This value can be substituted into the equation Ka=2.5, which becomes (2*pi*a)/wavelength. After rearranging to solve for the wavelength, the expression becomes:

$$\text{Wavelength}=(2*pi*a)/2.5 \quad (3)$$

This expression can then be solved for various values of the exit radius. Once the exit radius is established, the associated wavelength is calculated and the corresponding high frequency dispersion or radiation angle limit (for sound in air) can then be determined. This is the frequency where the radiation dispersion angle becomes less than the included angle between interior opposing surfaces of the horn walls (so the horn is unable to provide directional control of the waveform).

TABLE 2

| throat radius, a (inches) | wavelength (approx.) | corresponding frequency (approx.) |
|---|---|---|
| 0.4" | 1.0" | 13,500 Hz |
| 0.5" | 1.25" | 10,800 Hz |
| 0.55" | 1.38" | 9820 Hz |
| 0.6" | 1.51" | 9000 Hz |
| 0.7" | 1.76" | 7715 Hz |
| 0.75" | 1.88" | 7200 Hz |
| 1.0" | 2.51" | 5400 Hz |

It can be seen from the above data that as the throat radius, "a", is reduced, the high frequency limit is increased, implying that the horn/driver combination is capable of directional control at higher frequencies. This data describes the directional behavior of an un-flanged tube. When an acoustic "flange" is added the directional behavior will be altered (this change in the radiation pattern is shown in "*Acoustics*" by Beranek, FIG. 4.20). The dispersion in actually increased (i.e., the beamwidth increases) between Ka=1.5 and Ka=4. The data shown compares a piston in an infinite plane baffle, a piston at the end of a long tube (the data from tables 2 and 3) and a piston in free space (no baffle). The addition of a horn to the exit aperture of a driver will alter the directional response and, for certain values of Ka will increase the dispersion angle, or beamwidth. The horn will alter the dispersion characteristics much like the addition of a baffle in FIG. 4.20 of Beranek. This effect is shown in the actual measured data.

Prior art designs have resolved this inherent inability of a driver/horn combination to control dispersion at frequencies above the point where the exit radius became larger than the radiated wavelengths by utilizing a diffraction slot. This diffraction slot is placed at some distance beyond the plane referred to as plane "B" or plane "C".

Diffraction is an effect that produces spreading of a wave form when that wave form encounters a gap, or slit. The smaller the slit relative to the wavelength, the wider the resultant spreading of the waveform relative to its original. This spreading will increase the dispersion pattern, or beamwidth of the radiated wave. Diffraction slots are an effective way to broaden a wavefront that has become narrow due to the exit radius of the driver being large relative to the radiated wavelengths.

The use of diffraction slots can present two basic problems. The first problem is that diffraction slots represent a change in cross sectional area. This area change, or discontinuity, will produce a reflected wave in the horn. The reflected wave produces both time domain distortion as well as a change in the amplitude versus frequency response of the horn/driver system.

The second difficulty with diffraction slots, if they are located between the driver exit and the horn mouth, is that they can introduce path length differences associated with the physical geometry required to transition from the driver exit geometry to the narrow slot required to produce the necessary diffraction to achieve a requires dispersion, or beamwidth. These path length differences can result in uneven acoustical summing of the waveforms due to the phase differences associated with the different path lengths.

It should be noted that when a horn is designed to produce a specific radiation or dispersion pattern, discontinuities are typical. The designer's goal is to minimize the number and magnitude of those discontinuities.

Figure 4:
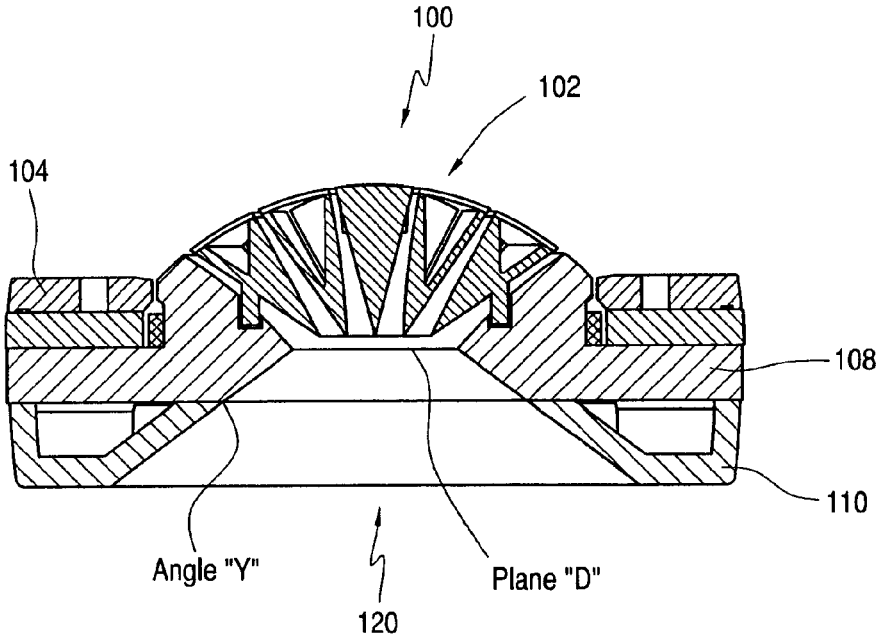
FIG. 4 is a second cross section, in elevation, illustrating an orthogonal view of the characteristics of the Equivalent Throat driver structure of FIG. 3, in accordance with the present invention.

A more detailed view of a typical implementation of an Equivalent Throat driver 100 of the present invention can be seen by comparing FIGS. 3 and 4. In both of these Figs plane "D" is the similar to plane "A" in FIG. 1. In this implementation, both drivers have identical phase plug summation plane radii. The conventional driver (shown in FIG. 1) has an exit radius larger than the phase plug summation radius. The Equivalent Throat driver 100 of the present invention (FIGS. 3 and 4) has an exit radius that is identical to and coincident with the phase plug summation plane. Based on the data in Tables 1 and 2, a smaller exit radius will produce a wider dispersion pattern (i.e., a larger included angle and larger beamwidth).

It can be seen in FIG. 3 that, for the horn throat of the present invention 120, the throat's walls define an included angle "X" beginning at plane "D". Because included angle X begins at plane "D", the driver/horn combination provided directional control to the wavefront at the optimal point, where the radius is smallest and the high frequency limit bandwidth is greatest. FIG. 4 illustrates the same driver 100 but shows a cross sectional view that is orthogonal to the view of FIG. 3, where the walls of throat 120 define an included angle "Y" also beginning at plane "D". A horn with a rectangular radiation pattern (i.e. 90 degrees horizontal by 40 degrees vertical, 120 degrees horizontal by 60 degrees vertical, 60 degrees horizontal by 40 degrees vertical, or any of a set of possibilities of horizontal by vertical rectangular geometries) is expected to have two different angles beginning at plane "D". It is also possible to have identical angles if the desired radiation pattern is square or a single angle if the desired pattern is oval in nature. (i.e. circular or elliptical or any other "round" geometry).

Figure 5:
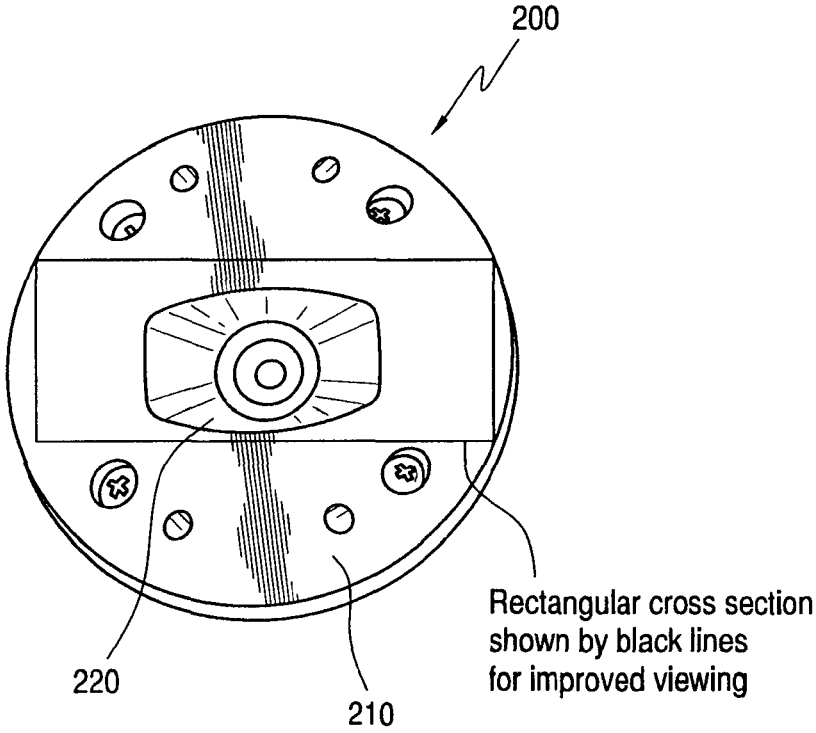
FIG. 5 is a bottom or throat-side view of a prototype of the ET driver of the present invention.

FIG. 5 is a photograph of a prototype embodiment of the Equivalent Throat (ET) driver 200 of the present invention. The superimposed rectangular black line illustrates the perimeter of the equivalent throat 220 (this line was added for clarity, since the photograph did not clearly show the perimeter of the equivalent throat section). As can be seen in FIG. 5, this prototype was designed to develop a rectangular radiation pattern. The metallic, interior portion of the geometry is the section of the magnetic return path's steel back plate that is shaped to form a portion of the actual throat 220. The equivalent throat design uses the entire thickness of the magnetic return path steel back plate to form the initial portion of the desired horizontal and vertical (for a rectangular implementation) radiation pattern of the driver/horn combination. The outer flange portion is an adaptor plate 210 but is not necessary for proper operation of the equivalent throat design. The salient feature of the design is that the desired radiation geometry begins at the phase plug summation plane where the exit radius can be made a minimum for any given driver design. This requires that the thickness of the back plate, from plane "A" (e.g., in FIG. 1) have the shape required to form the desired radiation geometry of the wavefront. This differs from a conventional design in that the conventional design has an exit radius on plane "B" (e.g., of FIG. 1). The conventional design's exit radius is displaced from the phase plug summation plane by the thickness of the magnetic return path steel back plate. The conventional design exit radius is larger than the radius at the phase plug summation plane. (The conventional design could be viewed as an unintentional subset of the equivalent throat design if the included angle between the phase plug summation radius and the larger exit radius were the desired included acoustic radiation angle for a horn of circular cross section.)

Figure 6:
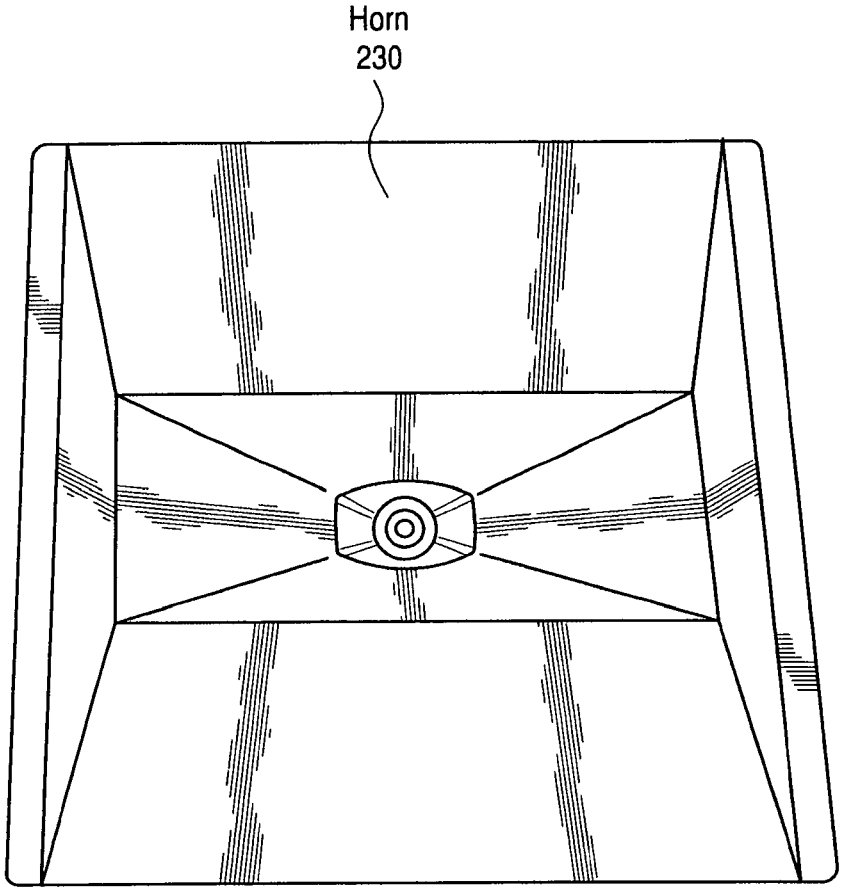
FIG. 6 is a bottom or throat-side view of the prototype of the ET driver of FIG. 5, with a matching ET horn attached, in accordance with the present invention.
Figure 7:
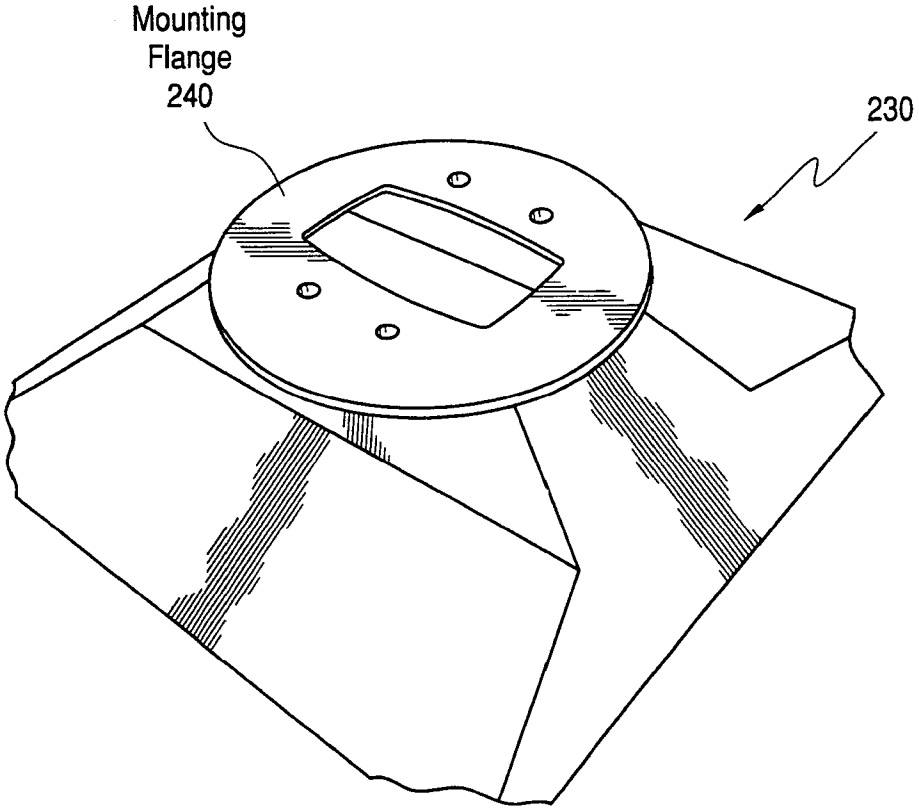
FIG. 7 is a rear perspective view of the ET horn of FIG. 6, in accordance with the present invention.

FIG. 6 illustrates an equivalent throat driver with a matching equivalent throat horn 230. An equivalent throat horn 230 differs from a conventional horn in that the entrance geometry of the horn must match the exit geometry of the driver or be adapted to the radius of the phase plug summation plane. In the exemplary embodiment shown in FIGS. 6 and 7 (which provides a rear view of the horn's mounting flange 240), the horn's widest included angle (in the case of a rectangular pattern implementation) matches that of the widest angle that the radius associated with the phase plug summation plane.

In accordance with the present invention, the entrance geometry of the horn matches the geometry of the driver's exit as defined (in the exemplary embodiment) by the interior surfaces of the backplate's central opening when mated to the horn's throat 220 to provide a virtually seamless horn interior sidewall from phase plug to well within the horn's throat. This means that a cross sectional view of the driver and horn assembly (e.g., of FIGS. 6-8) taken at any angle would show a co-linear interior sidewall surface that flares at a constant angle (e.g., angle Y as shown in FIG. 4) from within the driver's exit (e.g., plane D), across the plane of the driver/horn coupling and into the horn's throat.

Figure 8:
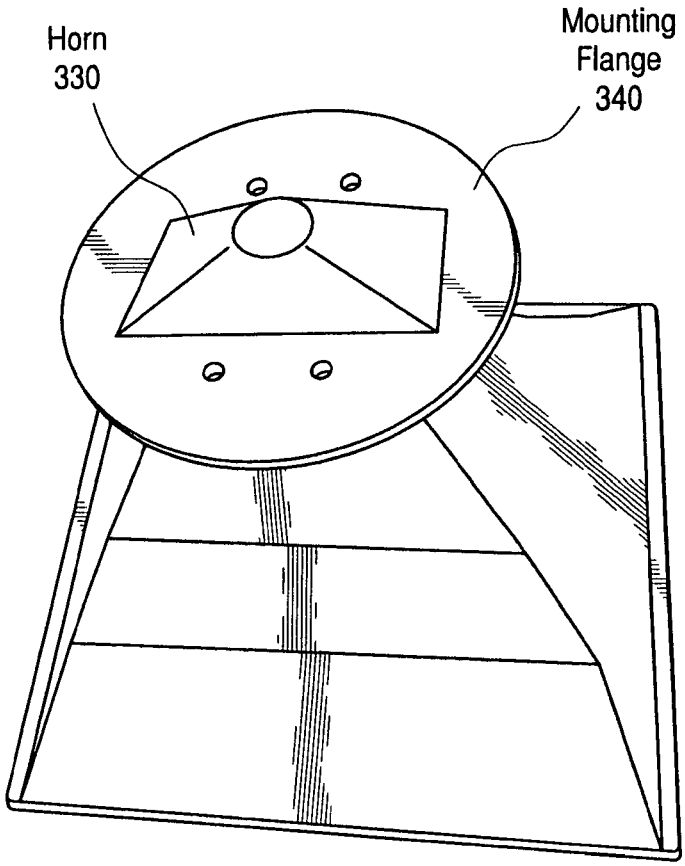
FIG. 8 is a rear perspective view of a rectangular dispersion pattern ET horn, in accordance with the present invention.

Other horn geometries, all with a rated beamwidth less than that supported by the phase plug summation plane radius may certainly be used with an equivalent throat driver. FIG. 8 illustrates a rear perspective view of prototype horn 330 with a rated −6 dB beamwidth of approximately 70 degrees in the horizontal plane and 40 degrees in the vertical plane. The unique geometry of the sidewall's interior surfaces on the entrance side of the horn (near mounting flange 340) matches the exit geometry of the of the sidewall's interior surfaces in the equivalent throat driver. The radius of the horn entrance matches the radius of the driver phase plug summation plane radius. The internal portion of the horn shown in FIG. 8 then becomes the required geometry to produce the desired acoustic dispersion. As is the case with every "equivalent throat" horn made in accordance with the present invention, the geometry of horn 330 in FIG. 8 has sidewall interior surfaces that begin diverging at a desired included angle at the plane of the horn entrance, which is coincident with the plane labeled "A" in FIG. 1.

Acoustical measurements of the horn and driver combination of the present invention indicate good agreement with the theory of the present invention. The radius of the phase plug summation plane for the equivalent throat driver is 0.55 inches. The radius at the exit of the conventional driver is 0.675 inches. The predicted difference in the high frequency dispersion limit is 1757 Hz. The measured difference is approximately 1800 Hz. This represents excellent agreement.

The absolute magnitude of the beamwidth's included angle (−6 dB points) and associated frequency, however, are different. The corresponding frequency for −6 dB included angles and a radius of 0.55 inches (the equivalent throat horn/driver combination) is approximately 9820 Hz. The measured frequency is approximately 11,400 Hz. (The conventional horn/driver, with an exit radius of 0.675 inches produces a measured included angle of approximately 9600 Hz). In both cases, the difference between the data calculated in tables 1 and 2 and the measured results are thought to be associated with acoustic end correction and boundary conditions.

The data shown in tables 1 and 2 ("Acoustics'" Beranek) was performed on unflanged pipes. The addition of the horn to the system will alter the acoustic conditions and modify the data shown in tables 1 and 2. The dispersion pattern is wider, and is in good agreement with the changes seen in Beranek's FIG. 4.20 between ka=1.5 and ka=4. The important result is that the difference between the equivalent throat driver and horn and the conventional driver and horn is very close to the theoretical prediction. In as much as the acoustic loads and boundary conditions presented by the two horns are similar, it is expected that the performance difference or "delta" between the two systems should be maintained.

Figure 9:
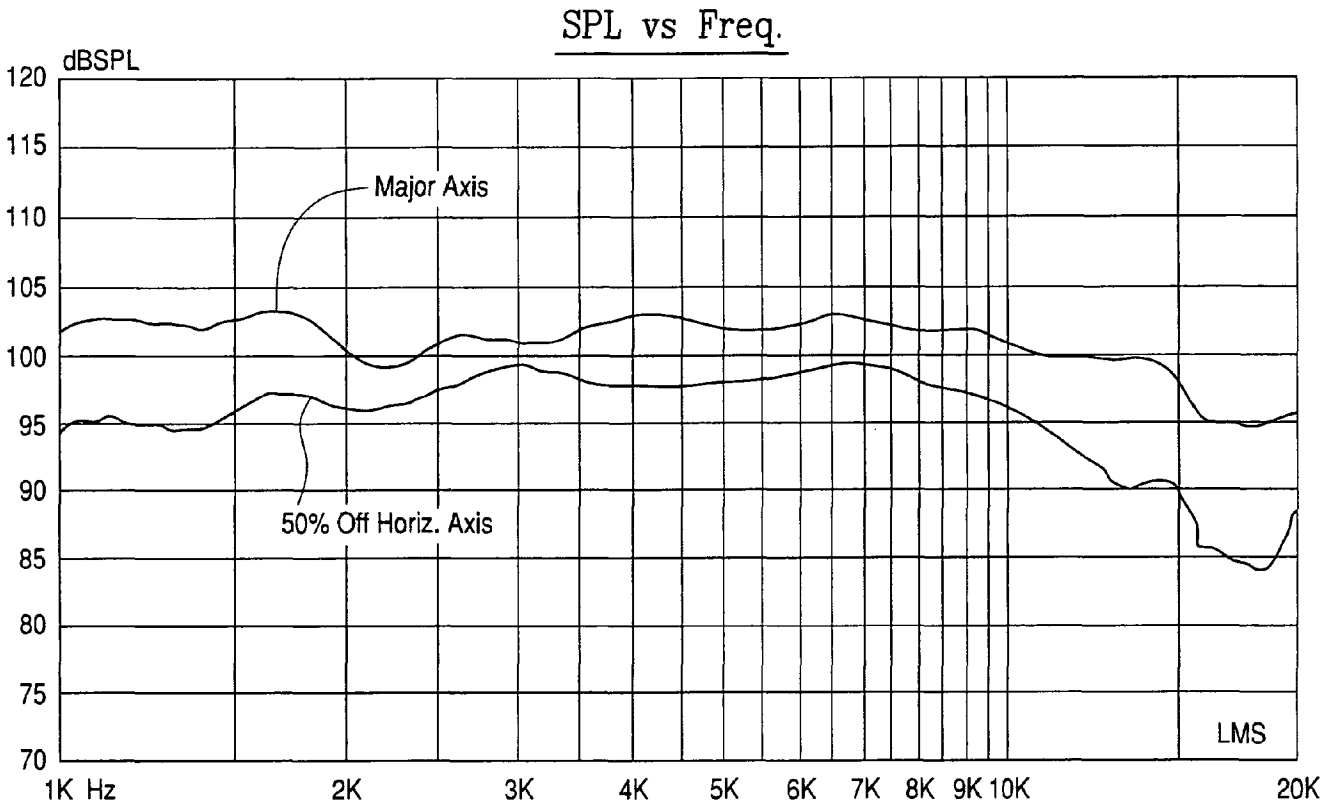
FIG. 9 is a plot illustrating measured amplitude v. frequency response for the ET driver and Horn of FIGS. 5 and 6.

FIG. 9 represents the amplitude versus frequency response of the equivalent throat driver 200 shown in FIG. 5 and the horn 230 shown in FIG. 6. The top curve is the response of the horn 230 and driver 200 on the major acoustic axis of the horn. The lower curve is the amplitude versus frequency response 50 degrees off the horizontal axis. (The horn 230 shown in FIG. 6 has a nominal horizontal included angle of 120 degrees and a vertical included angle of 60 degrees). This initial prototype was designed with a horizontal included angle greater than what the phase plug summation plane radius would support, per tables 1 and 2. The data presented in this figure clearly indicates a separation of greater than 6 dB above 10 kHz.

Figure 10:
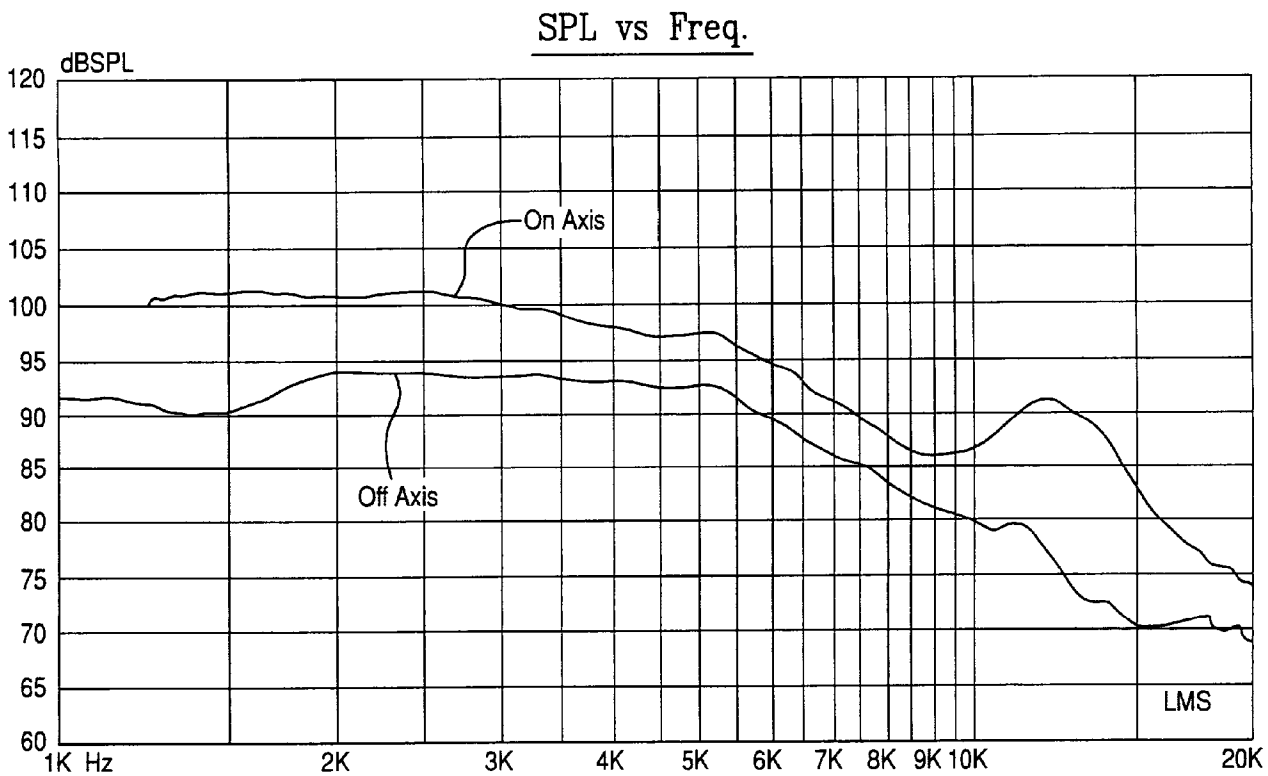
FIG. 10 is a plot illustrating measured on-axis and off-axis frequency response for a conventional driver and Horn.

FIG. 10 represents the on axis and off axis response of a conventional (i.e. non Equivalent Throat) driver and horn combination. It is clearly evident that the delta between the on axis response and off axis response begins to increase above 8 kHz. Table 3 is a list of selected data points for both the equivalent throat driver/horn combination and a conventional driver and horn. This table lists the on/off axis delta for each drive and horn combination

TABLE 3

| Frequency (Hz) | Equivalent Throat Delta | Conventional Delta |
|---|---|---|
| 9.6 kHz | 4.7 dB | 6.0 dB |
| 9.9 kHz | 4.7 dB | 6.8 dB |
| 10.5 kHz | 5.0 dB | 9.1 dB |
| 11.0 kHz | 5.5 dB | 10.1 dB |
| 11.5 kHz | 6.1 dB | 12.0 dB |
| 12.0 kHz | 7.2 dB | 14.5 dB |

As shown in table 3, the equivalent throat driver/horn combination of the present invention maintains a smaller delta between the on axis response and the off axis response, indicating the ability to maintain a wider main lobe beam width at a higher frequency.

It should also be stated that the −6 dB included angle for the equivalent throat driver/horn combination is 100 degrees and occurs at 11.5 kHz. The conventional driver/horn combination −6 dB included angle is 90 degrees and occurs at 9.6 kHz.

Figure 11:
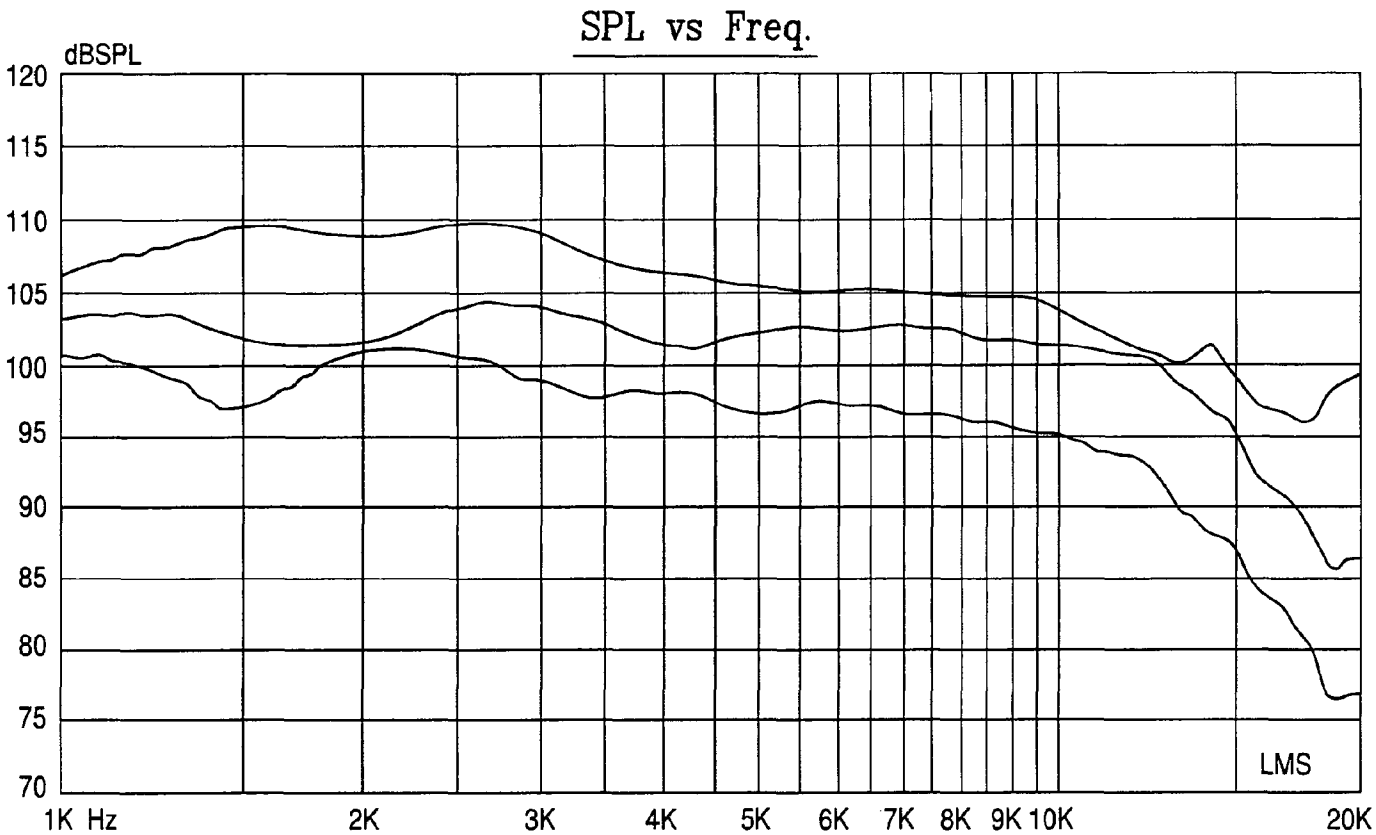
FIG. 11 is a plot illustrating measured on-axis and off-axis frequency response for the ET driver and Horn of FIG. 8.

Analysis of the second prototype equivalent throat horn 330 (rear side shown in FIG. 8) demonstrates the ability of the overall design concept to a variety of directional characteristics. As noted, the equivalent throat driver must incorporate the widest included angle to achieve the necessary dispersion. Additional horn geometries may then be designed with narrower dispersion angles. The response shown in FIG. 11 is that of the 70 degree horizontal by 40 degree vertical. FIG. 11 demonstrates that additional, but narrower dispersion pattern horns, will function in a traditional manner as long as the horn entrance radius matches the phase plug summation plane radius on the equivalent throat driver.

Conventional or prior art compression drivers have an exit radius that is larger than the phase plug summation radius and is separated some distance from the plane where the phase plug summation radius is located. Because the exit radius on conventional devices is larger than the summation plane radius, the high frequency dispersion performance of the driver is limited by the exit radius.

Equivalent throat driver/horn combinations (e.g., 200 and 230) utilize the compression driver summation plane radius as the exit throat. By utilizing the summation plane radius the high frequency dispersion limit is increased.

Equivalent throat driver/horn designs utilize the compression driver magnetic return back plate (e.g., 108) to provide an included angle (or combination of angles) to provide directional information to the emerging wavefront.

The widest dispersion horn has a rear geometry that matches the exit geometry of the equivalent throat driver. Other horns may easily be used with the equivalent throat driver providing the horn has its widest dispersion, or beamwidth, that is equal to or less than the included angle, or angles, on the equivalent throat driver.

The novel and unique aspect of the Equivalent Throat system is that the driver is capable of producing wider dispersion and beamwidth than a conventional driver because the exit radius is coincident with the phase plug summation plane. As has been shown, a smaller radius exit will produce a wider dispersion.

It will be appreciated by those having skill in the art that the Equivalent Throat system of the present invention is also capable of generating dispersions, or beamwidths, narrower than the included angle of the Equivalent Throat driver when other Equivalent Throat horns, of reduced dispersion angle are coupled to the driver. These reduced dispersion (higher Q) horns are coupled to the exit geometry of the Equivalent Throat driver by having an "inverse" geometry that will mate with the Equivalent Throat driver and allow the entrance radius of the horn to mate with the phase plug summation plane radius.

It will also be appreciated by those having skill in the art that the present invention makes available a transducer adapted for use as a loudspeaker, comprising a compression driver 100 having a phase plug 102 and compression driver exit 120 with a selected compression driver exit area (e.g., defined in a back plate 108) at a selected plane; a flared, impedance matching, horn (e.g., 230) having a proximal horn throat adapted to engage and receive an acoustic signal from said compression driver exit; wherein a radiation pattern is generated in response to excitation of the compression driver, and the radiation pattern includes horizontal and vertical radiation from the compression driver beginning at the exit plane of the phase plug where the radius of the substantially circular plane is much smaller than the exit radius or effective exit radius on the driver's backplate, such that the driver provides an "equivalent throat" design if at least one axis (horizontal or vertical for a rectangular radiation pattern) has an included angle equal to the beamwidth (−6 dB or otherwise defined) produced by the phase plug's summation plane radius.

Figure 12:
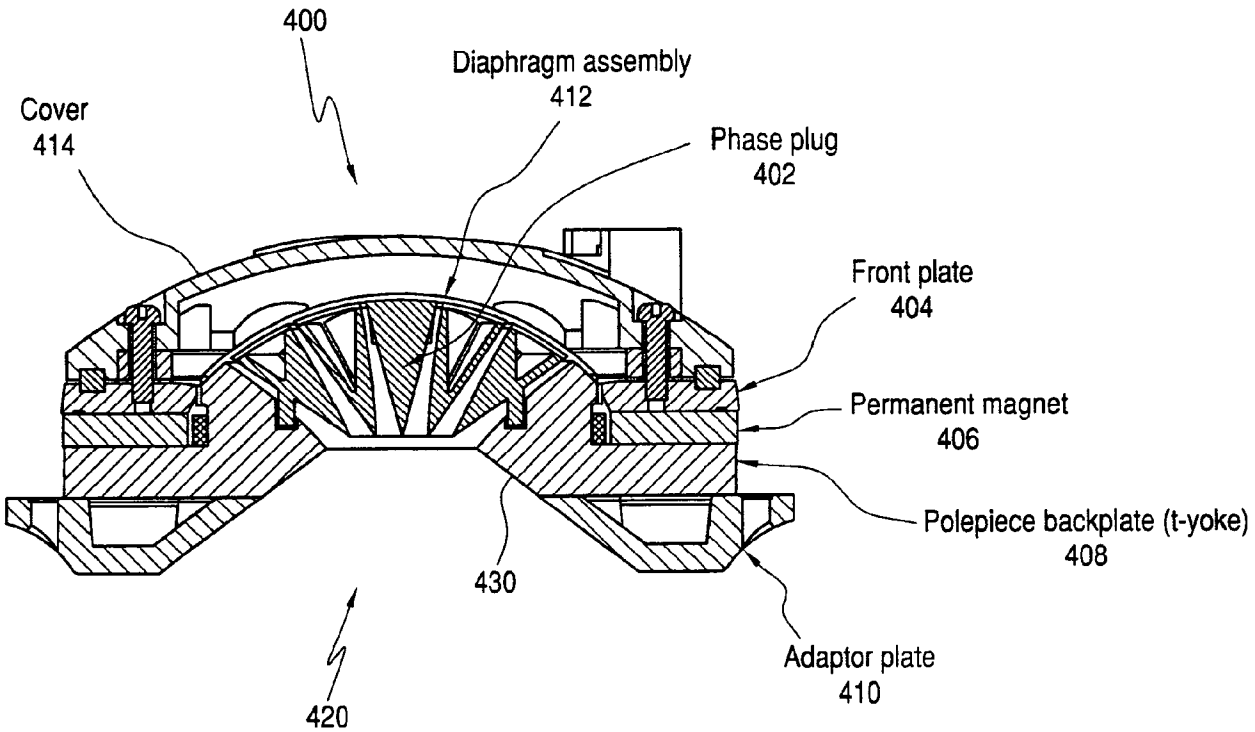
FIG. 12 is a cross sectional diagram illustrating the components of a preferred embodiment of the Equivalent Throat driver, in accordance with the present invention.
Figure 13A:
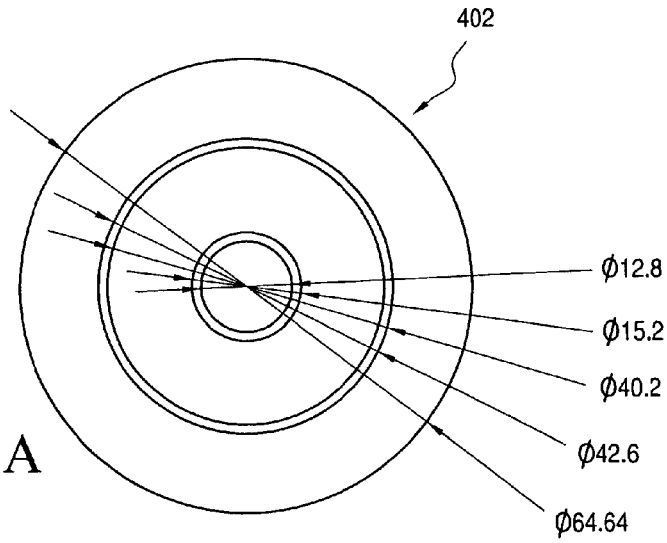
FIGS. 13A and 13B illustrate the Phase Plug of the Equivalent Throat driver of FIG. 12, in accordance with the present invention.
Figure 13B:
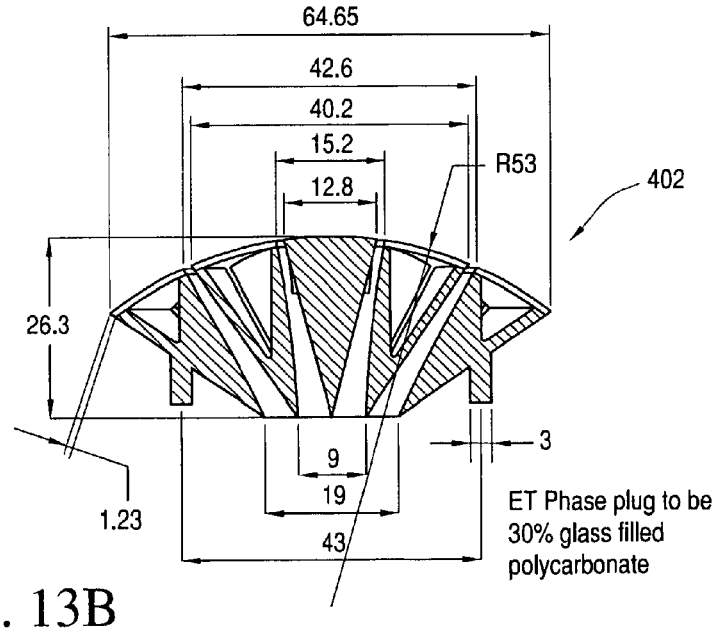

Turning to some other embodiments, FIG. 12 illustrates, in a cross sectional diagram the components of another Equivalent Throat driver 400, in accordance with the present invention. Driver 400 includes an annular magnet 406 stacked with annular front plate 404 which defines a magnetic gap at its inside peripheral edge. The inner peripheral edge of the magnetic gap is defined by Polepiece/backplate or T-Yoke 408 which is substantially symmetrical about a central axis that is co-axially aligned with the ET horn's throat 420. Polepiece/backplate or T-Yoke 408 is a ring-shaped member having an upper or diaphragm side and a lower or horn side, and the horn side has an axially aligned aperture therethrough with tapered inside walls and a central region of smallest diameter corresponding to "plane D", where the sidewalls on the horn side are angled away from one another by a selected angle chosen to provide the desired ET horn throat characteristics. Phase plug 402 is received in and supported by T-Yoke 408 and provides an impedance matching set of channels between the pressurized volume in front of diaphragm assembly 412 and the origin of the throat 420. FIG. 13A illustrates Phase Plug 402 of the Equivalent Throat driver 400 and 13B illustrates Phase Plug 402's tapered channels or vias in cross section, in accordance with the present invention.

ET Driver 400 includes a diaphragm assembly 412 with a diaphragm driven by a voice coil where the voice coil is suspended in a magnetic gap within the inner wall of front plate 404. Driver 400 has magnet 406 disposed proximate the magnetic gap to provide magnetic flux across the magnetic gap such that when an alternating current signal (e.g., a voice or music signal from an amplifier) is passed through the voice coil, the diaphragm is displaced in relation to the magnetic gap, thereby creating an acoustic pressure wave in a first region proximate the diaphragm. The diaphragm and the phase plug are part of a sound chamber with an interior surface and phase plug 402 defines a plurality of diaphragm exits (see FIGS. 12 and 13B) that are in fluid communication with a horn throat at an origin defined by at least one angled wall 430 (e.g., for a circular horn throat). Backplate 408 defines an axially aligned, tapered central lumen providing the origin of the horn throat at the selected plane (inside the backplate's lumen) and defines at least one boundary for the horn throat 420, whereby an acoustic pressure wave propagates from a first region proximate the diaphragm, through the phase plug's plurality of channels or diaphragm exits and through horn throat 420 such that directional control or influence of a sound wave projected into free space from this driver begins at the origin of horn throat 420.

Figure 14:
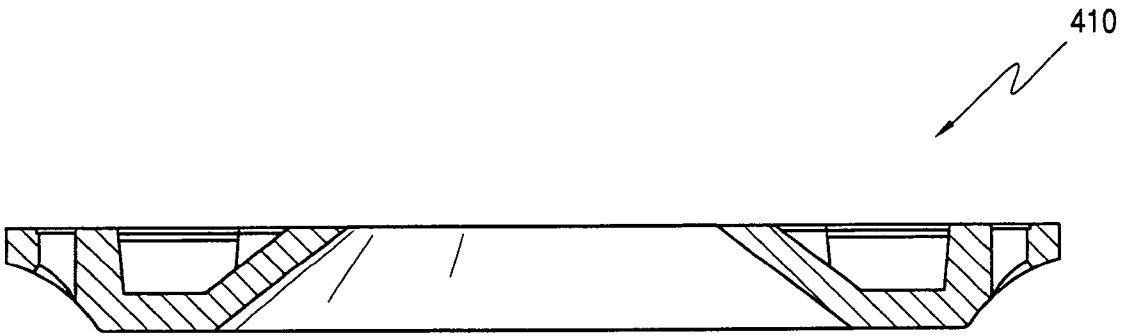
FIG. 14 illustrates the Adaptor Plate of the Equivalent Throat driver of FIG. 12, in accordance with the present invention.
Figure 15A:
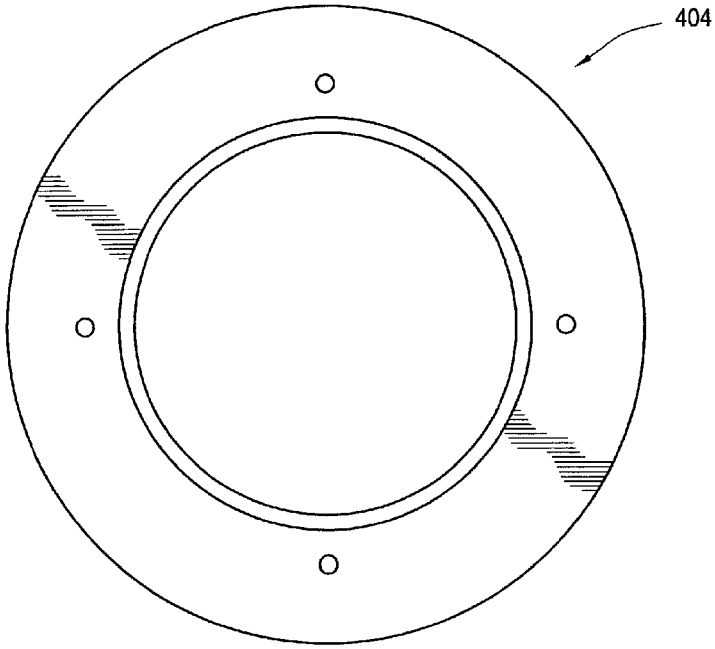
FIGS. 15A and 15B illustrate the Front Plate of the Equivalent Throat driver of FIG. 12, in accordance with the present invention.
Figure 15B:
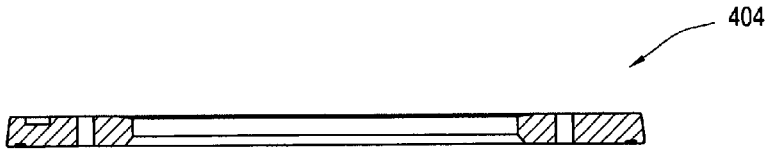
Figure 16A:
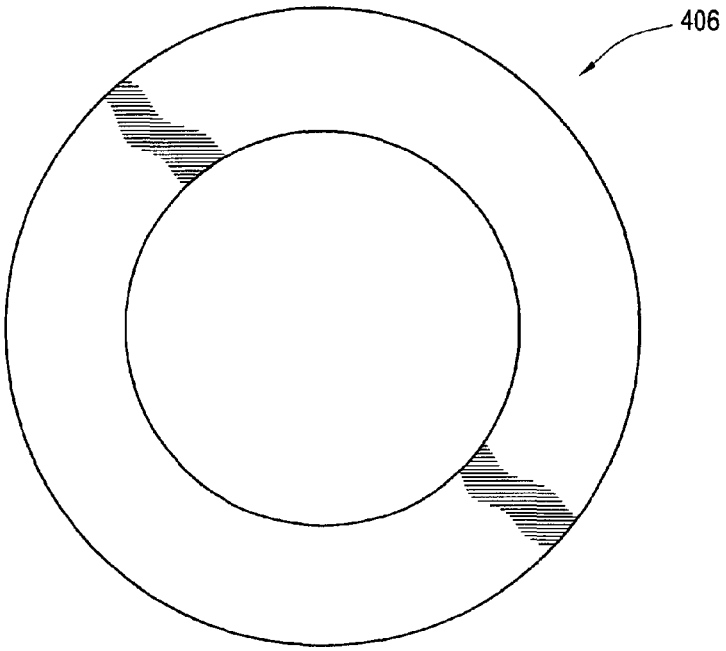
FIGS. 16A and 16B illustrate the Permanent Magnet of the Equivalent Throat driver of FIG. 12, in accordance with the present invention.
Figure 16B:
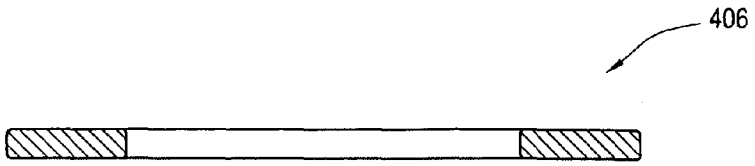
Figure 17B:
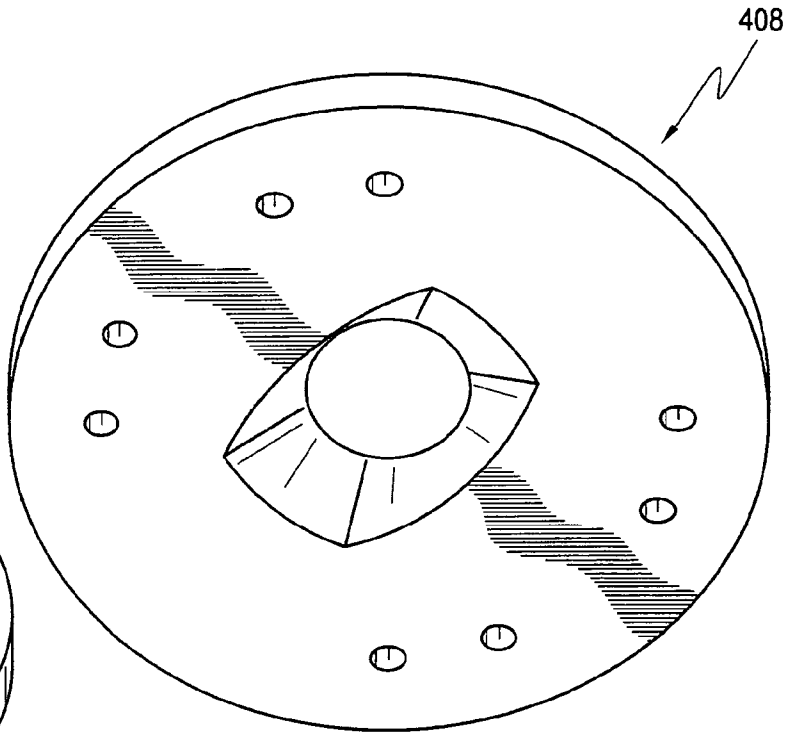
FIGS. 17A and 17B illustrate front and rear perspective views of the T-Yoke of the Equivalent Throat driver of FIG. 12, in accordance with the present invention.
Figure 17A:
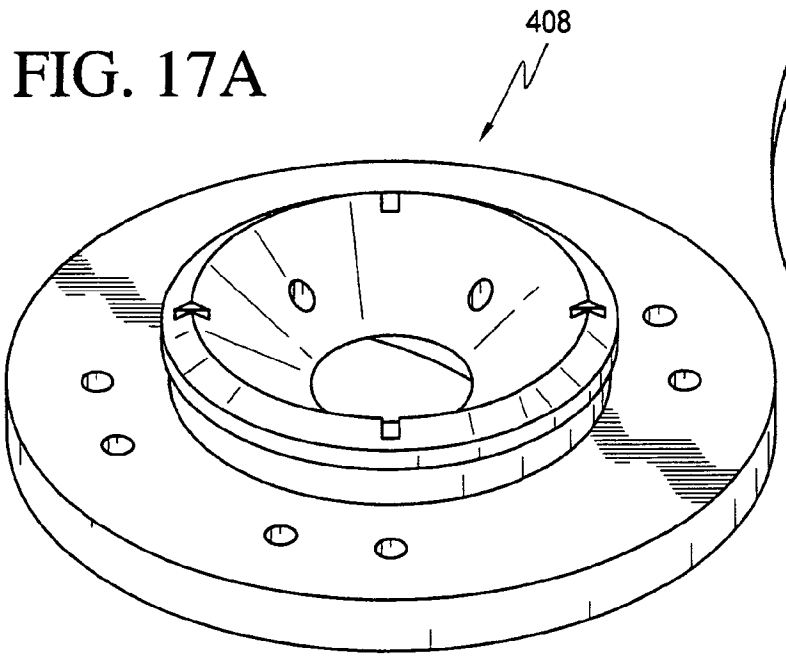
Figure 18:
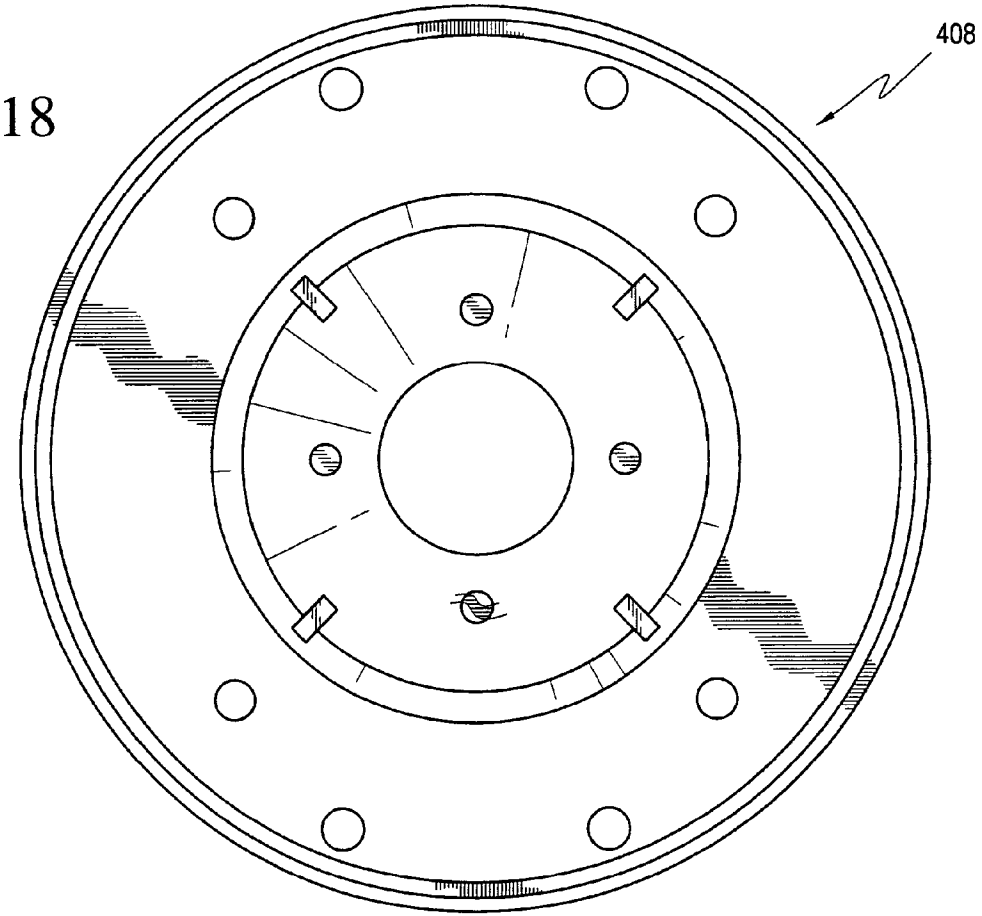
FIG. 18 illustrates a top view of the T-Yoke of the Equivalent Throat driver of FIG. 12, in accordance with the present invention.
Figure 19:
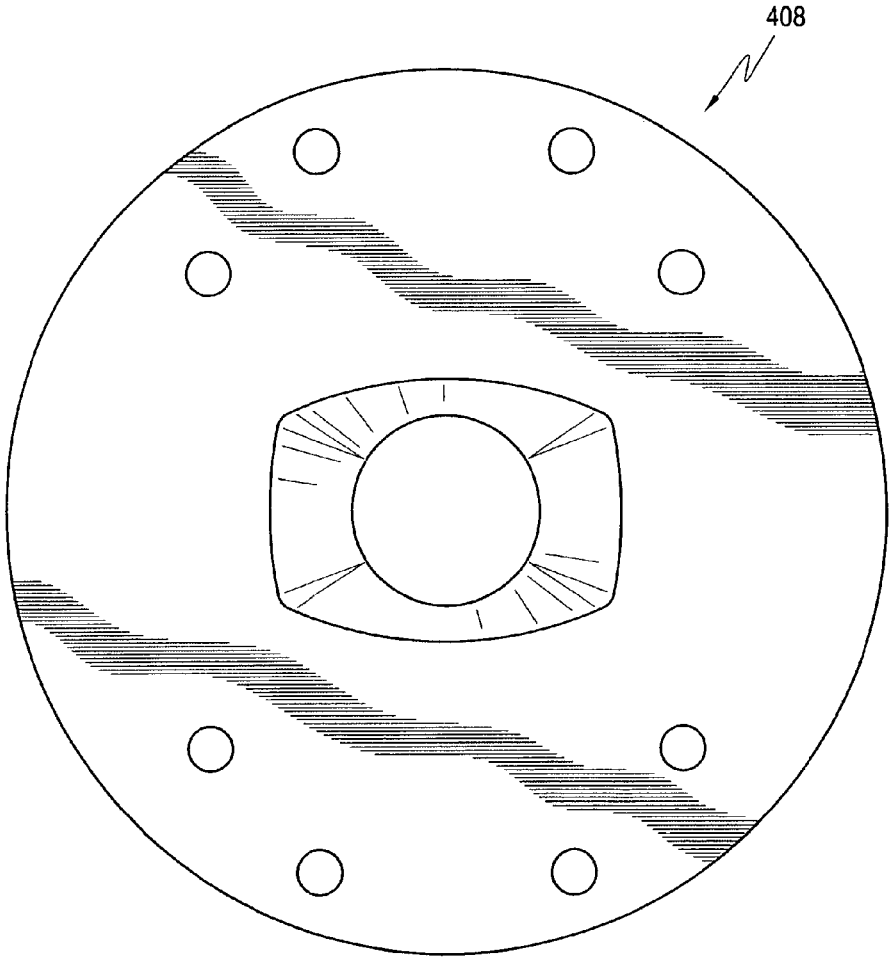
FIG. 19 illustrates the bottom view of the T-Yoke of the Equivalent Throat driver of FIG. 12, in accordance with the present invention.
Figure 20A:
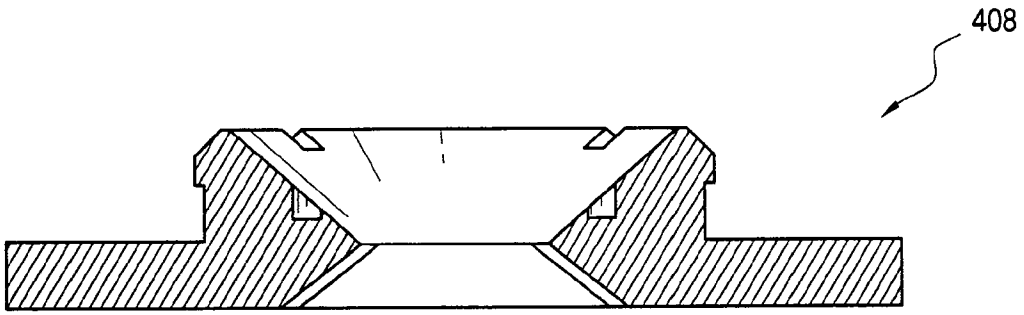
FIGS. 20A and 20B illustrate cross-sections of the T-Yoke of FIGS. 17*a*-19, in accordance with the present invention.
Figure 20B:
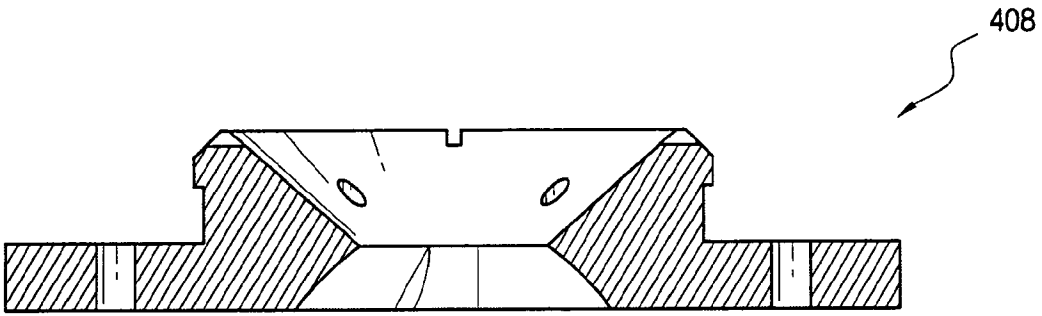
Figure 21B:
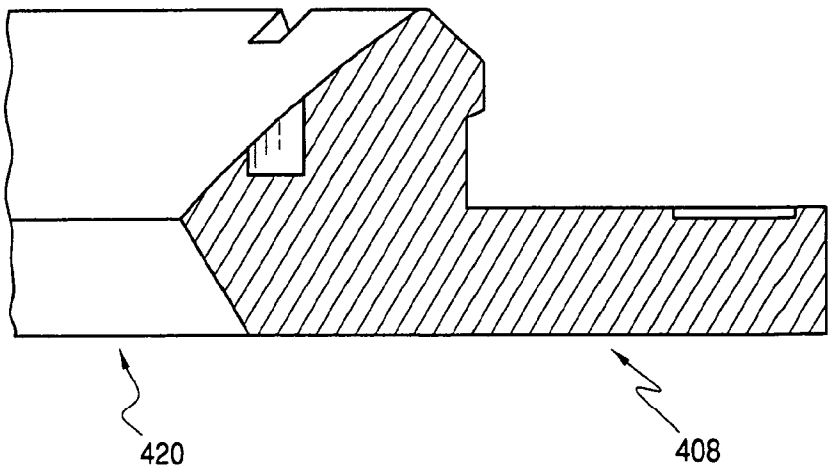
FIGS. 21A and 21B illustrate cross-sections of the T-Yoke of FIGS. 17*a*-20B, in accordance with the present invention.
Figure 21A:
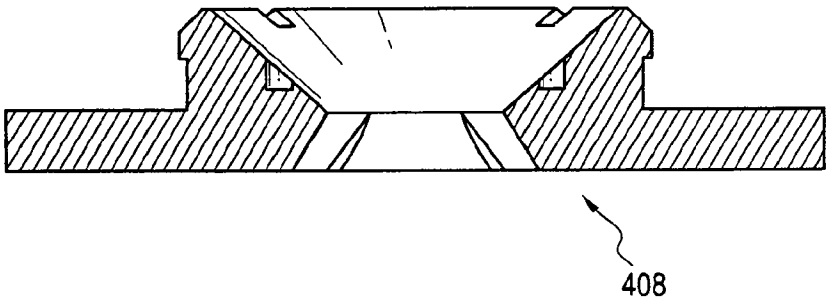
Figure 22A:
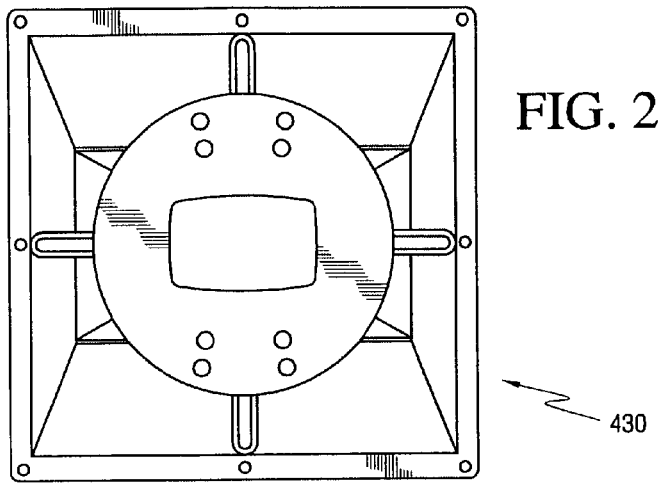
FIG. 22A-22D illustrate four views of an ET horn, in accordance with the present invention.
Figure 22C:
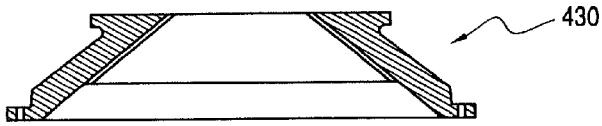
Figure 22B:
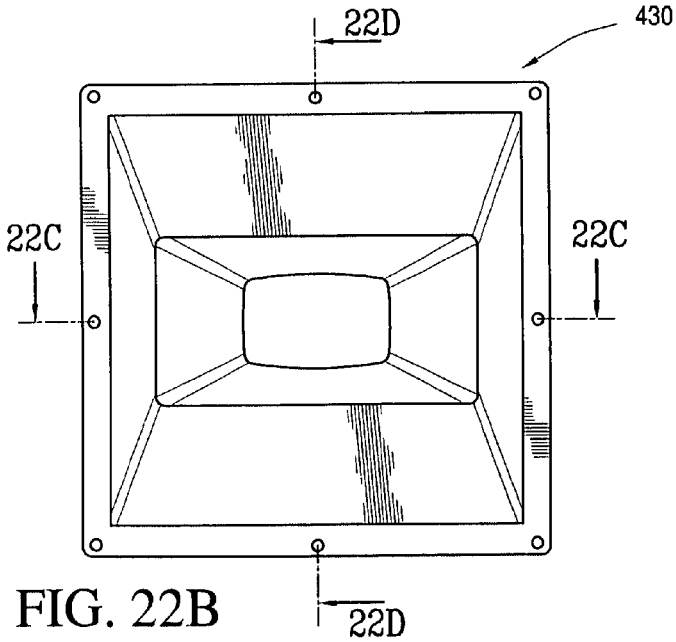
Figure 22D:
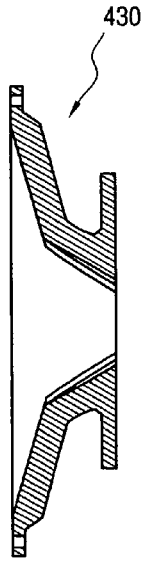
Figure 23A:
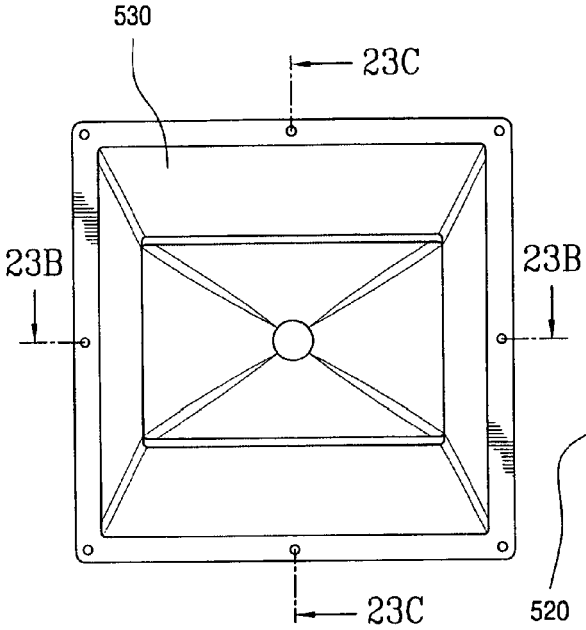
FIG. 23A-23C illustrate three views of an ET loudspeaker including an ET driver and an ET horn, in accordance with the present invention.
Figure 23C:
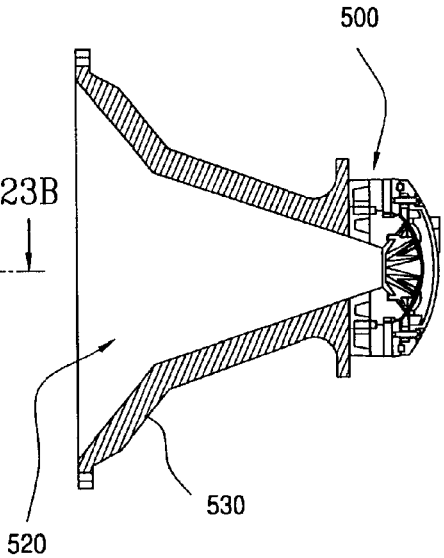
Figure 23B:
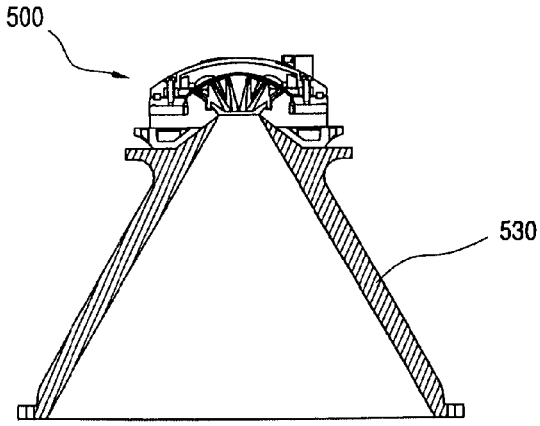
Figure 24A:
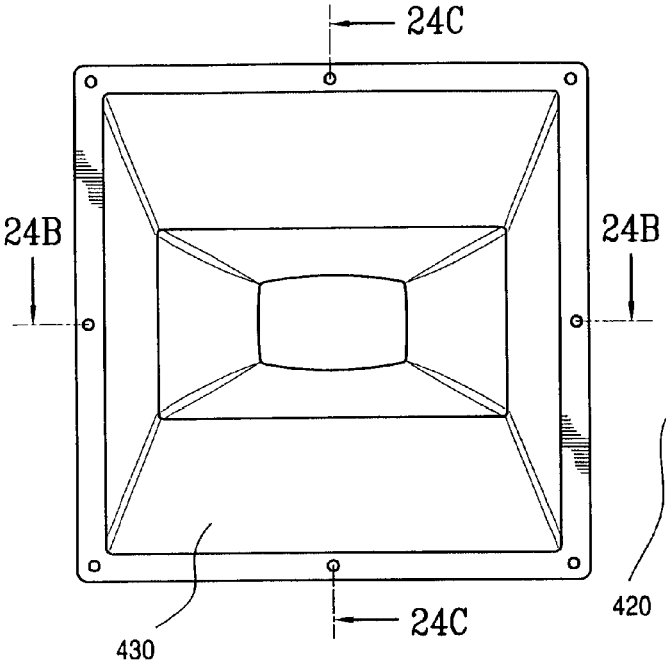
FIG. 24A-24C illustrate three views of another ET loudspeaker including an ET driver and an ET horn, in accordance with the present invention.
Figure 24C:
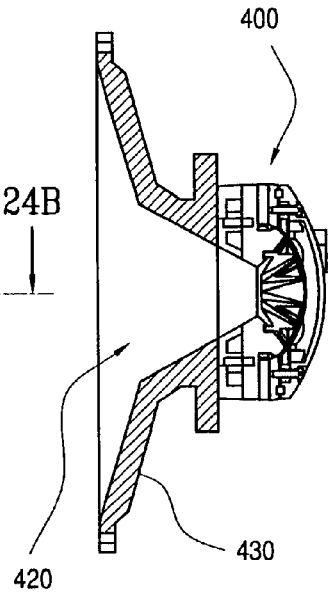
Figure 24B:
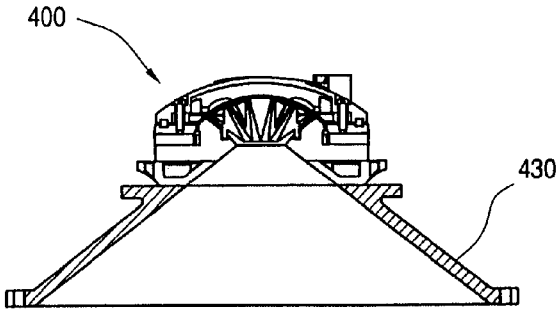

Adaptor Plate 410 of driver 400 is illustrated in FIG. 14 and FIGS. 15A and 15B illustrate Front Plate 404 of driver 400. FIGS. 16A and 16B illustrate Permanent Magnet 406 which is made of neodymium. FIGS. 17A and 17B illustrate front and rear perspective views of T-Yoke 408 and FIG. 18 illustrates a top view of T-Yoke 408 while FIG. 19 illustrates a bottom view of the T-Yoke 408 and shows the flared origin of throat 420 of the Equivalent Throat driver 400. FIGS. 20A and 20B illustrate cross-sections A-A and C-C from FIG. 18 of T-Yoke 408. FIGS. 21A and 21B illustrate cross-section B-B (also from FIG. 18) and a detailed view of the central throat region of section B-B of the T-Yoke 408. FIG. 22A-22D illustrate front, back and left and right side views of ET horn 430, in accordance with the present invention. FIG. 23A-23C illustrate front, top cross section and side cross section views of an ET loudspeaker including an ET driver 500 and an ET horn 530, in accordance with the present invention. FIG. 24A-24C illustrate front, top cross section and side cross section views of an ET loudspeaker including ET driver 400 (discussed above) and an ET horn 430, in accordance with the present invention.

Industrial Applicability

It will be appreciated by those having skill in the art that the present invention makes available a transducer adapted for use as a loudspeaker, comprising a compression driver having a phase plug and compression driver exit with a selected compression driver exit area (e.g., defined in a back plate) at a selected plane; a flared, impedance matching, horn having a proximal horn throat adapted to engage and receive an acoustic signal from said compression driver exit; wherein a radiation pattern is generated in response to excitation of the compression driver, and the radiation pattern includes horizontal and vertical radiation from the compression driver beginning at the exit plane of the phase plug where the radius of the substantially circular plane is much smaller than the exit radius or effective exit radius on the driver's backplate, such that the driver provides an "equivalent throat" design if at least one axis (horizontal or vertical for a rectangular radiation pattern) has an included angle equal to the beamwidth (−6 dB or otherwise defined) produced by the phase plug's summation plane radius.

Having described preferred embodiments of a new and improved method and apparatus, it is believed that other modifications, variations and changes will be suggested to those skilled in the art in view of the teachings set forth herein. It is therefore to be understood that all such variations, modifications and changes are believed to fall within the scope of the present invention as set forth in the claims.

What is claimed is:

1. A transducer adapted for use as a loudspeaker for generating an acoustic signal, comprising:

a compression driver having a diaphragm with a central axis, said diaphragm being suspended within the inner wall of a front plate to generate an acoustic signal;

a phase plug proximate said diaphragm and having a circular opening in an exit plane having a first area for passing said diaphragm's acoustic signal;

a planar backplate member with a tapered throat defined therein, said backplate throat defining a flared, linear interior sidewall surface which originates proximate said diaphragm's exit plane and defines at least one angled boundary for a horn throat;

an adapter plate with a central lumen adapted to engage said backplane member and receive said acoustic signal from said diaphragm via said backplate's tapered throat; said adapter plate including an interior sidewall segment which is co-linear with said angled boundary for said backplate throat;

a flared impedance matching horn segment having a proximal horn throat segment adapted to engage said adapter plate and receive an acoustic signal from said diaphragm via said backplate's tapered throat; said horn segment including an interior sidewall segment which is co-linear with said angled boundary for said horn throat;

wherein said backplate, said adapter plate and said horn segment define an axially aligned, tapered central lumen with at least one interior sidewall boundary having a selected included angle in a first plane for said horn throat and said flared horn segment; and whereby said acoustic signal propagates distally through said phase plug and through said backplate's tapered throat and wherein directional control of a sound wave projected into free space begins at said backplate's tapered throat.

2. The transducer of claim 1, wherein said transducer is a compression driver configured to generate a projected sound wave having substantially Constant Directivity in an axially aligned plane coplanar with said first plane and including said horn throat boundary having said selected included angle in said first plane.

3. The transducer of claim 2. wherein said backplate, said adapter plate and said horn segment define said axially aligned, tapered central lumen with a second interior sidewall boundary having a second selected included angle in a second plane which is orthogonal to said first plane; and wherein said compression driver is configured to generate said projected sound wave into a second axially aligned plane which is orthogonal with said first plane and including said horn throat boundary having said second selected included angle in said second plane.

4. The transducer of claim 3, wherein said second selected included angle in said second plane is vertical and orthogonal to said first plane; and wherein said second selected included angle in said second plane is a narrower angle than said first plane's included angle.

5. The transducer of claim 2, wherein said compression driver's exit plane first area defines a phase plug summation plane area having a selected radius;

wherein said phase plug summation plane area and said horn throat boundary's selected included angle are chosen together to provide substantially constant directivity in a selected plane for a projected sound wave having a selected beamwidth over a selected frequency range.

6. The transducer of claim 5, wherein said compression driver's selected summation plane area and said horn throat boundary's selected included angle are selected together to provide constant directivity for a projected sound wave;

wherein said selected phase plug summation plane area is configured as a circular area of approximately 0.55 inch radius, and wherein said horn throat boundary's selected included angle is a horizontal plane angle of 120 degrees, and wherein said projected sound wave has a selected horizontal beamwidth of 100 degrees when projected in a horizontal plane including said central axis, and said projected sound wave has an on-central-axis amplitude response which varies no more than + or −5 dB over a selected sound frequency range of 1 KHz to 15 KHz.

7. The transducer of claim 6, wherein said compression driver's selected summation plane area and said horn throat boundary's selected included angle are selected together to provide constant directivity for a projected sound wave, said projected sound wave's horizontal beamwidth extends laterally 50 degrees to opposing sides of said central axis to define 50 degree off axis reference points for amplitude response confirmation measurements, and said projected sound wave having a 50 degree off-axis amplitude response which varies no more than 5 dB from said on-axis amplitude response over a selected sound frequency range of 2 KHz to 10.5 KHz.

8. The transducer of claim 7, wherein directional control of said projected sound wave includes horizontal and vertical radiation pattern control from the compression driver beginning at the exit plane of the phase plug where the first area of the phase plug's exit is much smaller than the exit area of the adapter plate's tapered lumen, and wherein the driver provides an equivalent throat configuration with at least one axis having said included angle being at least equal to the beam-width produced by the phase plug's a co-linear interior sidewall surface which defines at least one angled boundary for said horn throat.

* * * * *